US006839531B2

(12) United States Patent
Saitoh et al.

(10) Patent No.: US 6,839,531 B2
(45) Date of Patent: Jan. 4, 2005

(54) BELT APPARATUS USED IN IMAGE FORMATION, AND AN IMAGE FORMATION APPARATUS

(75) Inventors: Masanori Saitoh, Tokyo (JP); Nobuyuki Yanagawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/814,862

(22) Filed: Mar. 23, 2001

(65) Prior Publication Data

US 2001/0028812 A1 Oct. 11, 2001

(30) Foreign Application Priority Data

Mar. 30, 2000 (JP) ..... 2000-095330
Oct. 13, 2000 (JP) ..... 2000-313331

(51) Int. Cl.[7] ..... G03G 15/00; G03G 15/01; G03G 15/16

(52) U.S. Cl. ..... 399/167; 399/302; 399/313

(58) Field of Search ..... 399/49, 101, 116, 399/162, 163, 167, 223, 298, 299, 302, 303, 308, 312, 313, 350

(56) References Cited

U.S. PATENT DOCUMENTS 4,647,961 A 3/1987 Kammoto et al.
4,760,427 A 7/1988 Oyama et al.
4,841,358 A 6/1989 Kammoto et al.
4,968,997 A 11/1990 Saitoh et al.
5,017,969 A * 5/1991 Mitomi et al. ..... 399/299
5,083,160 A 1/1992 Suzuki et al.
5,121,166 A * 6/1992 Miyamoto et al. ..... 399/312
5,194,959 A 3/1993 Kaneko et al.
5,390,010 A * 2/1995 Yamahata et al. ..... 399/308
5,404,206 A 4/1995 Andoh et al.
5,701,566 A 12/1997 Bisaiji et al.
5,740,492 A * 4/1998 Deki et al. ..... 399/302 X
5,790,930 A * 8/1998 Fuchiwaki ..... 399/302
5,899,603 A * 5/1999 Markovics ..... 399/167
5,966,561 A * 10/1999 Yamaguchi ..... 399/302 X
5,983,060 A 11/1999 Namekata et al.
6,006,062 A 12/1999 Takahashi et al.
6,035,158 A * 3/2000 Asakura et al. ..... 399/101
6,148,163 A * 11/2000 Ito ..... 399/299 X
6,157,797 A 12/2000 Saito et al.
6,188,861 B1 * 2/2001 Parker et al. ..... 399/299
6,215,974 B1 4/2001 Katoh et al.
6,223,008 B1 4/2001 Takahashi et al.
6,269,228 B1 7/2001 Kayahara et al.
6,308,027 B1 10/2001 Obu et al.

FOREIGN PATENT DOCUMENTS

EP 0895134 A2 * 2/1999
JP 11-295952 * 10/1999
JP 2001-249551 9/2001

* cited by examiner

*Primary Examiner*—Sandra Brase
(74) *Attorney, Agent, or Firm*—Oblon, Spivak, McClelland, Maier & Neustadt, P.C.

(57) ABSTRACT

In a belt apparatus used for image formation structured such that processing unit used for image formation are placed around a belt extended between at least two rollers and at least one of the processing unit acts on a roller so as to impart a rotational load thereto, it is possible to avoid a reduction in the image quality of a transfer image on the belt caused by the roller that supports the belt receiving variations in the load due to the movement towards or away from the belt of a cleaning blade. A drive source is connected to the roller to which directly receiving the load variation making this roller the drive roller for the belt.

63 Claims, 17 Drawing Sheets

BELT APPARATUS USED IN IMAGE FORMATION, AND AN IMAGE FORMATION APPARATUS

FIELD OF THE INVENTION

The present invention relates to a belt apparatus used in image formation and to an image forming apparatus.

BACKGROUND OF THE INVENTION

Two types of image forming apparatus that use endless belts are used as an image forming unit. One of these apparatuses uses the belt as an intermediate transfer medium, and a plurality of image forming unit are placed around the belt and color toner images are transferred on top of each other directly onto the belt so as to form color toner images having either a plurality or a multiplicity of colors. Thereafter, the color toner images are transferred to a sheet shaped medium such as a paper. Thus this apparatus is known as an intermediate transfer type of color image forming apparatus.

The other apparatus uses the belt as a means for transporting the paper. This apparatus also has a plurality of image forming units placed around the belt, however, the paper is transferred together with the belt and a color image is obtained by sequentially transferring color toner images on top of each other onto the paper using the image forming unit during the transporting process. Therefore, this type of apparatus is known as a tandem type of image forming apparatus.

1. Intermediate Transfer Type Image Forming Apparatus

An example of an intermediate type color image forming apparatus is disclosed in Japanese Patent Application Laid-Open (JP-A) No. 10-177286. As shown in FIG. 17A, a belt 10 serving as an intermediate transfer medium is extended between two rollers 12 and 13 provided facing each other at a distance. The belt 10 is rotated by these rollers and a processing unit used for forming an image are placed around the belt 10.

If the direction in which the belt rotates is taken as that indicated by the arrow a, then a first image forming unit 14 and a second image forming unit 24 are provided beneath the belt 10 and between the roller 12 and the roller 13 as a processing unit which forms an image in the order given going from the upstream side in the direction of rotation of the belt. Moreover, a transfer roller 11 is provided so as to be able to be moved towards or away from the roller 13, and a cleaning blade 61*a* is provided so as to be able to moved towards or away from the roller 12.

The first image forming unit 14 is provided with a photoconductor drum 16 serving as an image carrier; not shown electrification unit placed around the photoconductor drum 16; not shown optical writing unit; a first developing apparatus 6 serving as a first developing unit comprising a A color developer 19 serving as a developing unit and a C color developer 20 serving as a developing unit; and a not shown cleaning unit.

The second image forming unit 24 is provided with a photoconductor drum 26 serving as an image carrier; not shown electrification unit placed around the photoconductor drum 26; not shown optical writing unit; a second developing apparatus 8 serving as a second developing unit comprising a B color developer 29 and a D color developer 30; and a not shown cleaning unit.

The image forming process is based on a typical electrostatic recording process, as will be noticed from the first image forming unit 14 and entails using optical writing unit to write an electrostatic latent image in a particular color onto a photoconductor drum that has been uniformly charged in darkness by an electrostatic unit, and then visualizing this electrostatic latent image using the first developing apparatus 6 and transferring the toner image onto the belt 16 (intermediate transfer).

Both the first developing apparatus 6 in the first image forming unit 14 and the second developing apparatus 8 in the first image forming unit 14 have the function of visualizing images each using toner of two different colors. Therefore, if black is added to the three primary colors to give four colors, then if these four colors are shared between each of the developers 19, 20, 29, and 30, it is possible to create a four color image.

Accordingly, if, while the same image formation area of the belt 10 is sequentially passing the two image forming apparatuses 14 and 24, as a result of transfer bias imparted by a first transfer brush 41 and a second transfer brush 42 serving as an intermediate transfer unit (a first transfer unit) that are provided facing the photoconductor drums 16 and 26 respectively with the belt 10 sandwiched between the respective brushes and photoconductor drums, a toner image is transferred in each color one by one on top of the other onto the belt 10 and, while the image formation area of the belt 10 onto which two colors have been transferred one on top of the other is sequentially passing the above two image forming unit 14 and 24 once again, toner images of different colors to the ones transferred in the previous transit are transferred in superposition by each of the image forming unit, then, at the point when the image formation area has passed twice over each of the image forming unit 14 and 24, it is possible to obtain a full color toner image by the superposed transfer onto the same image area.

The full color toner image is then transferred (i.e. the final transfer) onto paper P which is a sheet shaped medium. This transfer is performed by applying transfer bias to the transfer roller 10 used for the final transfer that has been placed in a state in which, at the time of transfer, it is rotated by pressure from the roller 13 below via the belt, and by passing the paper P through the nip portion between the transfer roller 11 and the belt 10. After the final transfer, the full color toner image carried on the paper P is fixed by a not shown fixing unit enabling a full color final image to be obtained on the paper P.

In this image forming process, using the position of the transfer roller 11, for example, as a reference, A color and B color toner images are transferred one on top of the other on the same image formation area of the belt 10 after the first rotation of the belt 10. Further, C color and D color toner images are further transferred one on top of the other on this same image formation area of the belt 10 after the second rotation of the belt 10. Thereafter, these four color superposed toner images are transferred onto the paper P.

When a four color superposed toner image is formed on the paper P and the four color superposed toner image arrives at the transfer roller 11, the transfer roller 11 need to be press contacted against the roller 13 in order to perform its transferring function. However, because it is necessary to allow the A color and B color superposed toner image to pass through without being damaged at all at the point when the A color and B color superposed toner image arrive, the transfer roller 11 is moved away from the roller 13 at this time. Therefore, the transfer roller 11 has such a construction that it can be moved towards or away from the roller 13 in the image forming process.

When the toner image is transferred onto the paper P by the transfer roller 11, residual toner remains on the belt 10.

This residual toner contaminates the surface of the belt 10 and causes the images that are formed subsequently to be damaged. It is therefore necessary to remove this transfer residual toner prior to subsequent transfers by the image formation unit 14 and 24, and a cleaning unit is provided as this removal unit.

The cleaning blade 61*a* functions as the above-mentioned cleaning unit and it has such a construction that it can be moved towards or away from the roller 12 via the belt 10. This cleaning blade 61*a* is also controlled so as to be able to move towards or away from the belt 10 at the time when the A color and B color superposed toner image passes the position of the blade 61*a* such that the A color and B color superposed toner images formed during the first rotation of the belt 10 are not removed by cleaning. Immediately after the four color superposed toner image (i.e. the toner image formed from the A color, the B color, the C color, and the D color) is transferred onto the paper P, the blade 16*a* makes contact with the belt 10 and cleans it only when the relevant image formation area is passing the blade 61*a* in order for the transfer residual toner to be removed.

The cleaning blade 61*a* is moved towards or away from the roller 12 during the image formation process. The first image forming unit 14, the second image forming unit 24, the transfer roller 11, the cleaning blade 61*a*, the transfer brushes 41 and 42 and the like comprise the processing unit used for image formation provided around the belt 10.

In this type of intermediate transfer type of image forming apparatus, in order to increase the transfer accuracy of the transfer roller 11 acting as the final transfer unit, conventionally, a structure has been employed in which the roller 13, which can be moved towards or away from the transfer roller 11 via the belt 10, is used as the drive roller for the belt 10 and a drive source MO2 is linked to the roller 13.

The structure thus comprises the transfer roller 11 moving towards or away from the roller 13 via the belt 10 and the cleaning blade 61*a* moving towards or away from the roller 12 via the belt 10, and both of these impart a rotation load variation to their corresponding roller. However, if a comparison is made between the load variation affecting the roller 12 due to the movement of the cleaning blade 61*a* and the load variation affecting the roller 13 due to the movement of the transfer roller 11, then the load variation affecting the roller 12 is overwhelmingly greater. The reasons for this are because the transfer roller 11 has been designed so as to have reduced rotation resistance and to be freely rotatable when in contact, and because the impact at the time of contact is minimal due to highly elastic materials being used.

In contrast to this, due to its function, the cleaning blade 61*a* is positioned so as to be in contact with the belt at an angle whereby it tends to dig into the roller 12. Moreover, because a hard resin material is used due to its properties when scraping away the residual toner, the impact at the time of contact is large.

Therefore, if the cleaning blade 61*a* is moving relative to the belt 10 when the photoconductor drum 16 or the photoconductor drum 26 are transferring a toner image onto the belt 10, the roller 12, which is the slave roller, is directly affected by the variations in the load and, although only slight, unevenness occurs in the rotation thereby causing the tension on the belt 10 to vary.

On the other hand, because the rotation speeds of the photoconductor drums 16 and 26 are constant, the relative speed between the belt and the periphery of the photoconductor drum changes due to the variations in the belt tension, and it has been determined that color misregistration arises in the intermediate transfer image in the first image forming unit 14 and the second image forming unit 24 and pitch unevenness is generated.

With a tandem type belt, an extremely long circumference needs to be secured, however, the molding of the endless belt is prohibitively expensive. Therefore, normally, a sheet shaped endless belt is used and the two ends thereof are joined together by adhesive or the like to form a pseudo endless belt. However, during image formation, it is imperative that the joint be avoided (i.e. not be used).

The color image forming apparatus disclosed in JP-A No. 10-177286 has developing apparatuses 6 and 8 positioned around photoconductor drums 16 and 26, as shown in FIG. 17A, and toner of one color is supplied to the photoconductor drum for each revolution of the photoconductor drum so as to develop an electrostatic latent image which is then transferred onto the belt 10. The transferred toner image of the first color then has the toner image of the second color transferred in superposition on the first color toner image in the second rotation of the belt 10. The third and fourth color toner images are then transferred in the same way.

Thus, by sequentially transferring the toner images in the four colors on top of each other on the belt 10, a full color toner image is formed on the belt 10. Thereafter, processes to transfer and fix the toner image onto the paper P are performed. In an image forming apparatus that uses the belt 10 as an intermediate transfer body in this way, through holes and reflective marks and the like are provided in the vicinity of both edges in the transverse direction of the belt 10 and a transmission type or reflection type of photosensor is provided on the image forming apparatus body or on the belt unit for detecting the holes or reflective marks. The timing at which the image is then written onto the photoconductor drum is then controlled on the basis of the detected timing.

A further reflection type of photosensor is also provided for detecting the density of the toner transferred onto the belt 10. Process controls such as electrostatic bias control and transfer bias control are then performed on the basis of the signal levels of the toner density pattern formed (i.e. of the toner density) for each color. Typical examples of this intermediate transfer belt mark (or hole) sensing are the technologies disclosed in JP-A Nos. 5-35124, 9-54476, 9-106199, 9-96943, 7-036249, 11-249526, 11-160928, 11-65397, and 11-223976. Moreover, a typical example of the toner density sensing method is the technology disclosed in JP-A No. 9-304997.

In the image forming apparatus, as explained above, that uses a belt as the intermediate transfer body, a toner density detection unit for process control and a belt mark detection unit for a combination of at least four colors are provided for the belt, and the accuracy and stability of the detection are among the most important factors affecting the image quality. Therefore, the detection needs to be performed with a high level of accuracy. However, the detection position, namely, the position of the photosensor for a belt in the conventional format, as can be seen in the conventional example, is located for a particular reason at the outer peripheral circumference of belt support rollers positioned facing each other so as to support the belt. In some cases this position is at substantially the central area between the support rollers, however, in the majority of typical apparatuses, the position where the photosensor is located is not given a great deal of consideration and it is generally fit into any space leftover as a result of the structural layout of the apparatus.

However, if no consideration is given to the location of the photosensor because precedence is being given to the layout, there is a risk that the accuracy of the detection will be deleteriously affected. For example, it is not preferable for the photosensor to be placed near the developer where it is most likely to be affected by splashes and spillages of toner, or for the photosensor to be located facing upwards even if it is not placed close to the developer as these locations are affected by toner contamination (i.e. by toner adhering to the light emitting and light receiving surfaces of the photosensor).

If the photosensor is placed at a position away from the support roller, then vibration when the belt is being driven and slackness increase the further the belt is located away from the belt support rollers. In particular, because marked vibration is generated in the extended surface on the slack side, the accuracy when using an optical detection method whose depth range is narrowly limited, such as is the case with a photosensor, is reduced.

The technology disclosed in JP-A No. 11-223976 is intended to provide a technology for solving the above problem, however, a special part known as a backing member is required. Moreover, in the technology disclosed in JP-A No. 9-54476, the outer peripheral surface of the belt support rollers is used, however, an extremely high degree of accuracy is required in the positioning of the photosensor and the roller when performing detection at the curvature position and if there is even a slight amount of mispositioning, the fear exists that the detection accuracy and stability will be reduced.

As shown in FIG. 17A, in the color image forming apparatus disclosed in JP-A No. 10-177286, two image forming units of same shape are provided below the belt 10. The extended surface of the belt 10 facing these image forming units become the tensioned side surfaces when the belt 10 is driven. Moreover, during the first transfer, the belt 10 that has been moved away by the transfer brushes 41 and 42, which are provided with approach/separation mechanisms, is made to approach the photoconductor drums 16 and 26.

In order to increase the transfer efficiency, it is necessary to bend the belt 10 using the transfer brush rollers 41 and 42 and to sufficiently press the photoconductor drums 16 and 26 so as to obtain the contact width between the photoconductor drums 16 and 26 and the belt 10. In other words, during intermediate transfer, force to make the transfer brushes bend the belt 10 and force to press the photoconductor drums 16 and 26 are necessary.

Therefore, in a structure in which the bottom side of the belt is made the tensioned side extended surface, because it is necessary for the contact to be maintained and not be pushed backwards by the tension in the belt, even greater force is necessary. Moreover, because the structure uses a plurality of image forming units, namely, the first image forming unit 14 and the second image forming unit 24, and because transfer brushes are provided in each image forming unit, considerable force is needed for moving the transfer brushes at the extended surface on the tensioned side of the belt 10. Alternatively, the fear arises that the transfer will be poor because of the narrow transfer width.

2. Tandem Type Image Forming Apparatuses

Tandem type image forming apparatuses such as that shown in FIG. 17B are also known. In FIG. 17B, the belt 10' having a holding function of holding paper is extended between rollers 12' and 13', which serve as support members, facing in a horizontal direction.

Photoconductor drums 71Y, 71M, 71C, and 71BK, which serve as image carrying bodies for carrying toner images in each of Y (yellow), M (magenta), C (cyan), and BK (black) are arranged in a row adjacent to the belt 10' in the above order from the upstream side in the direction of rotation of the upper belt of the belt 10' as shown by the arrow.

Around each of the photoconductor drums 71Y, 71M, 71C, and 71BK, non-contact type electrostatic devices 72Y, 72M, 72C, and 72BK, that use corona discharge wire, cleaning units 1Y, 1M, 1C, and 1BK, and the like are provided in the above order in the rotation direction. Developing rollers 4*a* provided for each developing apparatus 74Y, 74M, 74C, and 74BK are arranged adjacent to the corresponding photoconductor drum.

The image forming apparatus is formed from the respective photoconductor drums and the electrostatic devices, developing apparatuses, cleaning units, and the like arranged around the photoconductor drums. In other words, image forming units 14BK', 14C', 14M', and 14Y' are arranged in that order facing the belt 10 as means for forming images using the respective colors Y, M, C, and BK.

The non-contact type transfer apparatuses 73Y, 73M, 73C, and 73BK which use discharge wire via the belt 10' are provided facing the photoconductor drums 71Y, 71M, 71C, and 71BK in the image forming units 14BK', 14C', 14M', and 14Y'.

Moreover, writing unit 18' is provided above the photoconductor drums 71Y, 71M, 71C, and 71BK. Exposure light Lb that has been modulated in accordance with color image signals is emitted and irradiated onto an exposure section between the developing apparatus and the electrostatic apparatus in each photoconductor drum 71Y, 71M, 71C, and 71BK.

The belt 10' is driven to rotate in the counter clockwise direction, as shown by the arrow. A pair of resistance rollers 75 are provided at a position further upstream than the upstream end of the upper belt of the belt 10'. The paper P is fed by a supply roller 76 towards the resistance rollers 75.

A fixing apparatus 50' is provided at a position further downstream than the downstream end of the upper belt of the belt 10'. A non-contact type of static electrifier 78 that uses corona discharge wire is provided as a paper suction unit above the roller 12' supporting the belt 10' at the upstream end portion of the upper belt of the belt 10' such that paper is electrostatically suctioned to the belt 10'. A removal unit 79 for deelectrifying the paper P so that it can be easily removed from the belt 10' is provided at a position facing the roller 13' at the downstream end of the upper belt of the belt 10'.

A non-contact type of deelectrification unit 80 that uses corona discharge wire in order to deelectrify the belt 10' is provided at the lower belt of the belt 10'. A cleaning blade 61*a*' which can be moved towards or away from the roller 12' via the belt 10' is also provided in the roller 12' portion. This blade 61*a*' is moved so that it can avoid the joints in the belt 10'.

The image forming units 14BK', 14C', 14M', and 14Y' provided around the belt 10', the optical writing unit 18', the transfer apparatuses 73BK, 73C, 73M, and 73Y, the static electrifier 78, the cleaning blade 61*a*', the deelectrification unit 79 and 80, and the like are means for executing the image formation processing.

In this image forming apparatus, the image forming is carried out in the following manner. When each of the photoconductor drums 71Y, 71M, 71C, and 71BK begin to rotate, the photoconductor drums are uniformly electrified in darkness during the rotation by the electrostatic devices 72Y, 72M, 72C, and 72BK. Exposure light Lb is then irradiated and scanned onto the exposure section with the writing timing shifted, and a latent image corresponding to the image to be created is formed. Toner images are then formed by the developing apparatuses 74Y, 74M, 74C, and 74BK so as to be transferred on top of each other on the same paper P.

The paper P stored in a paper supply section is fed out by the paper feed rollers 76. This paper then passes along the transporting path shown by the broken line and is temporarily stopped at the position of the pair of resistance rollers 75. The paper then waits for a time at which it can be fed out so as to match up with the toner images on the photoconductor drums 71Y, 71M, 71C, and 71BK at the transfer section. When the time arrives, the paper P that had been stopped by the resistance rollers 75 is fed out from the resistance rollers and is transported while being suctioned to the belt 10' by the static electrifier 78. At this time, the belt 10' is controlled by the marks or the like such that the paper is not placed on top of the joints in the belt 10'. Consequently, each of the toner images on the photoconductor drums are sequentially transferred onto paper S in the transfer sections where the paper makes contact with each of the photoconductors. The colors are thus superposed and a full color toner image is produced.

The positions where each of the photoconductor drums 71Y, 71M, 71C, and 71BK comes into contact with the belt 10' form transfer sections and each of the transfer apparatuses 73Y, 73M, 73C, and 73BK are located in these transfer sections.

The paper P onto which the full color toner image has been transferred is deelectrified by the deelectrifying unit 79 and is then separated from the belt 10'. It is then fed as it is to the fixing apparatus 50' where fixing is performed and is discharged onto the paper discharge tray 81.

The residual toner remaining on the photoconductor drums 71Y, 71M, 71C, and 71BK reaches the cleaning units 1Y, 1M, 1C, and 1BK due to the rotation of the photoconductor drums, and the photoconductor drums 71Y, 71M, 71C, and 71BK are cleaned as they pass the cleaning units so as to be ready for the formation of the next image. After the paper P has been separated from the belt 10', the belt 10' is deelectrified by the deelectrifying unit 80. It then arrives at the cleaning blade 61*a*' serving as cleaning means where it is cleaned and prepared for the transporting of the next paper.

The cleaning of the belt 10' by the cleaning blade 61*a*' is performed because a portion of the toner images from the photoconductor drums 71Y, 71M, 71C, and 71BK is transferred onto the belt 10' and also because paper dust from the paper sticks to the belt 10' and the cleaning is performed in order to prevent this transferred toner and paper dust and the like from contaminating the next paper.

In a tandem type of color image format, the downstream side roller 13' is made the driver roller for the belt 10' in order to tension the upper belt on which the paper P has been placed and a drive source MO2 is linked to the drive roller 13'.

Here, the cleaning blade 61*a*' has such a construction that it can be moved towards or away from the roller 12' via the belt 10' and imparts a rotation load variation to the roller towards which and away from which it is moved. The load variation affecting the roller 12 as a result of the movement of the cleaning blade 61*a*' is large enough to temporarily alter the tension on the belt 10' for the same reason that applies to the cleaning blade 61*a* in the above described intermediate transfer type image forming apparatus.

If the cleaning blade 61*a*' is moving towards or away from the belt 10' when the photoconductor drums 71Y, 71M, 71C, and 71BK are transferring a toner image onto the paper P on the belt 10', the slayer roller 12' is directly affected By this load variation and the tension on the belt 10' changes.

On the other hand, because the rotation speeds of the photoconductor drums 71Y, 71M, 71C, and 71BK are constant, the relative speed between the belt and the periphery of the photoconductor drum temporarily changes due to the variations in the belt tension, and it has been determined that color misregistration arises in the transferred toner image and pitch unevenness is generated.

SUMMARY OF THE INVENTION

It is an object of the present invention is provide a belt apparatus used for image formation and an image forming apparatus in which any reduction in the image quality of transferred images that is caused by the roller supporting the belt being affected by load variations can be avoided.

It is another object of the present invention to provide an image forming apparatus, having a simple structure that does not require any special parts and that makes it difficult for the detecting unit to be affected by the toner, which enables the position of the belt to be detected stably and accurately throughout the life of the image forming apparatus, and thereby enables excellent images to be consistently obtained.

The belt apparatus according to one aspect of the present invention has following construction. A belt is extended between at least two rollers provided opposite to and at a distance from each other and the belt is rotated by the rollers. A plurality of processing units used for image formation are arranged around the belt and the processing units are made to function while the belt is being rotated. At least one of the processing units acts on any one of the two rollers while an image is being formed on the belt thereby imparting a rotational load variation to that roller. The roller to which a rotational load variation is directly imparted by the processing units is set as a roller that drives the belt.

The image forming apparatus according to another aspect of the present invention has following construction. A belt serving as an intermediate transfer body that has a function of carrying a toner image is extended between two rollers provided facing each other at a distance and the belt is rotated by the two rollers. Processing units used for image formation are provided. These processing units include an image forming unit that is provided with a developing unit for developing an electrostatic latent image formed in advance on an image carrier as a toner image having a plurality of colors and that causes the image carrier to come into contact with the belt; an intermediate transfer unit for transferring a toner image on the image carrier that has been developed by the developing unit onto the belt; and a final transfer unit for transferring a toner image on the image carrier that has been transferred onto the belt by the intermediate transfer unit onto a sheet shaped medium. Processing is performed so that the processing units are made to function while the belt is being rotated, and at least one of the processing unit acts on any one of the two rollers via the belt thereby imparting a rotational load variation to that roller. When the roller to which a rotational load variation is imparted by the processing units is set as a roller that drives the belt, the image forming units are placed at the extended surface of the belt which is the non-tensioned side when the drive roller is being driven.

The image forming apparatus according to another aspect of the present invention has following construction. A belt having a function of carrying a sheet shaped medium is extended between at least two rollers provided opposite to and at a distance from each other and the belt is rotated by the rollers. Processing units used for image formation are provided. The processing units include an image forming unit that is provided with a developing unit for developing an electrostatic latent image formed in advance on an image carrier as a toner image; and a transfer unit for transferring a toner image on the image carrier that has been developed by the developing unit onto the sheet shaped medium that has been transported together with the belt. Processing is performed so that the processing units are made to function in order to form an image while the belt is being rotated, and at least one of the processing units acts on any one of the two rollers thereby imparting a rotational load variation to that roller. The roller to which a rotational load variation is imparted by the processing units is set as a roller that drives the belt.

The image forming apparatus according to another aspect of the present invention has following construction. A toner image formed on an image carrier is transferred by an intermediate transfer unit onto a belt serving as an intermediate transfer body, and the toner image on the belt is transferred onto a sheet shaped medium by a final transfer unit, wherein the belt is extended by being suspended between a plurality of rollers that include a drive roller and there is provided image forming unit equipped with a single image carrier and a developing unit for developing an electrostatic latent image on the image carrier in toners of a plurality of colors, and the image forming unit is provided facing the extended surface of the belt on the non-tensioned side when the belt is being driven, and a sensing unit is provided at a position facing the extended surface of the belt on the tensioned side when the belt is being driven for detecting a state of the image forming apparatus and allowing control to be performed.

The image forming apparatus according to another aspect of the present invention has following construction. A color toner image formed in at least the three primary colors A, B, and C on an image carrier is transferred by intermediate transfer unit onto a belt serving as an intermediate transfer medium, and a color toner image on the belt is transferred onto a sheet shaped medium by a final transfer unit, wherein the belt is extended by being suspended between a plurality of rollers that include a drive roller, and there is provided a first image forming unit and a second image forming unit placed a predetermined distance apart along the surface that forms the same moving surface of the belt, and the first image forming unit is provided with a single image carrier and a developing unit for developing an electrostatic latent image on the image carrier in A color toner and with a developing unit for developing an electrostatic latent image on the image carrier in C color toner, and the second image forming unit is provided with a single image carrier and a developing unit for developing an electrostatic latent image on the image carrier in B color toner, and when the belt is driven, the first image forming unit and the second image forming unit are positioned at the non-tensioned extended surface of the belt, and a sensing unit for detecting a state of the image forming apparatus and allowing control to be performed is provided at the tensioned extended surface of the belt.

The image forming apparatus according to another aspect of the present invention has following construction. A belt, which is suspended between a plurality of rollers such that a non-tensioned side extended belt surface, which is an image holding surface onto which an image is transferred from among the belt surfaces, faces downwards and a tensioned side extended belt surface faces upwards, and whose drive roller and rotation direction are determined; a sensing unit positioned above the tensioned side extended surface of the belt for detecting a state of the image forming apparatus and allowing control to be performed; a first image carrier and a second image carrier on which an electrostatic latent image is formed are positioned in sequence in a direction of movement of the belt below the non-tensioned side extended belt surface; a first developing unit for developing an electrostatic latent image on the first image carrier from among the image carriers in A color and C color toner and a second developing unit for developing an electrostatic latent image on the first image carrier from among the image carriers in at least B color toner, the first developing unit and second developing unit being positioned in the same way in sequence in a direction of movement of the belt below the non-tensioned side extended belt surface which is the belt holding surface; a first transfer unit positioned facing the first image carrier and the second image carrier for transferring a toner image formed on the first image carrier and the second image carrier onto the belt; a second transfer unit positioned in the vicinity of the downstream side of the second image carrier in the direction of movement (direction of rotation) of the belt for transferring a toner image formed in color on the belt onto a sheet shaped medium; a transport path on which the sheet shaped medium is supplied by paper supply unit and is fed from the bottom of the apparatus body towards the top of the apparatus body facing the second transfer unit; and a fixing apparatus positioned above the belt in the vicinity of the second transfer unit for fixing a toner image transferred by the second transfer unit on the sheet shaped medium.

Other objects and features of this invention will become apparent from the following description with reference to the accompanying drawings.

BRIEF DESCRIPTION OF THE DRAWINGS

FIG. 9A is a view showing the structure of the entire image forming apparatus, while

FIG. 10A is a typical view of an example of the formation of a transfer bias circuit in the intermediate transfer unit, while

FIG. 14A is a view showing variations in the belt speed when no cushioning unit is provided, while

FIG. 17A is a schematic structural view of a conventional intermediate type of image forming apparatus, while

DESCRIPTION OF THE PREFERRED EMBODIMENTS

Preferred embodiments of the belt apparatus used for image formation and the image forming apparatus according to the present invention will now be described. Intermediate transfer type image forming apparatus:

(1) Belt Apparatus for Image Formation

Figure 1:
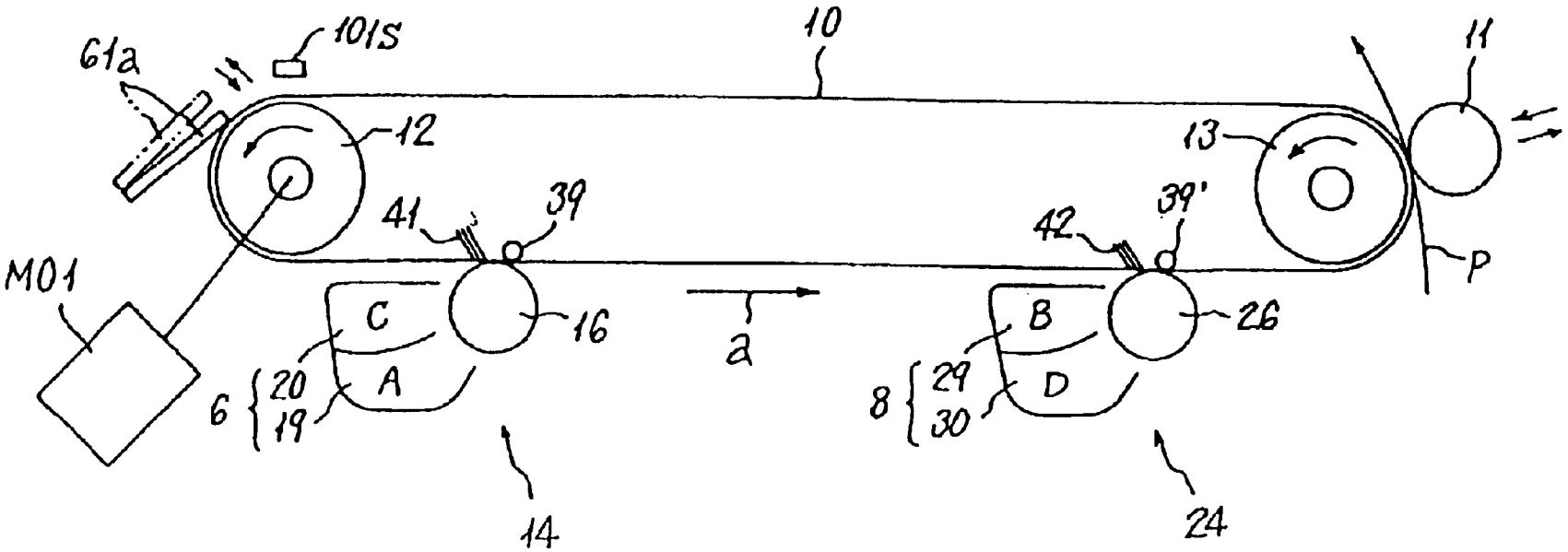
FIG. 1 is a view showing the belt apparatus used for image formation as well as the main portions of the image forming apparatus according to the present invention.

FIG. 1 shows an example of a belt apparatus used for image formation and an image formation processing unit. Note that the same structural elements as in the belt apparatus used for image formation shown in FIG. 17A, which was described as an example of conventional technology, are provided with the same legends.

The belt 10 is extended between two rollers 12 and 13 provided at a distance from and facing each other. The belt 10 is rotated by these two rollers 12 and 13.

The first image forming unit 14, the second image forming unit 24, the transfer roller 11, the cleaning blade 61*a*, the transfer brushes 41 and 42, and the like are provided as processing unit which forms an image around the belt 10. Other elements are also provided and these will be described where necessary. Note that, as the processing unit for forming an image, there are both elements that form a portion of the image formation belt apparatus and elements that do not form a portion of the belt apparatus for image formation.

The transfer roller 11, the cleaning blade 61*a*, the transfer brushes 41 and 42, and the like do form a portion of the belt apparatus for image formation, however, the first image forming unit 14 and the second image forming unit 24 do not form a portion of the belt apparatus for image formation, but instead form a portion of the image forming apparatus.

In this example, the roller 12 is set as the roller having drive force by connecting a drive source MO1 to the roller 12. Accordingly, in the description below, the roller 12 is referred to as the drive roller 12. The cleaning blade 61*a* is provided in a movable manner as explained in connection to the conventional device. When the belt 10 is rotated in the direction shown by the arrow a, the first image forming unit 14, the second image forming unit 24, and the like are made to function during this rotation and an image is formed on the belt 10. However, during image formation, a rotation load variation is applied to the cleaning blade 61*a* at the point where the belt winds around the roller 12 such that the cleaning blade 61*a* is moved towards or away from the roller 12 via the belt 10.

However, because the drive source MO1 is linked to the roller 12, even if there is a load variation due to the movement of the cleaning blade 61*a*, there is no change in the tension on the belt 10 as a result of this load variation.

Thus, even if the roller 12 is affected by a load variation due to the cleaning blade 61*a*, there tends to be no variation in the rotation and, consequently, no variation in the tension on the belt 10. Thus pitch unevenness and color misregistration caused by shifts in the transfer image on the belt are done away with.

Here, while an image is being formed on the belt 10 by the first image forming unit 14 and the second image forming unit 24, when the transfer roller 11 moves relative to the roller 13 via the belt 10, a load variation is directly imparted to the roller 13 as a result of this movement, however, as described above, there is a far greater amount of variation in the load imparted to the roller 12 by the cleaning blade 61*a* than in the load imparted to the roller 13 by the transfer roller 11.

The larger the variation in the load received by the roller supporting the belt, the greater the effect that variation in the tension on the belt caused by the load variation has on the accuracy of the image formation. Accordingly, when there is a plurality of processing units imparting load variation, it is possible to reduce pitch unevenness and color misregistration caused by shifts in the transfer image due to the load variation by setting the roller, to which the rotation load variation is being imparted by the processing unit that is imparting the largest load variation out of the plurality of processing units, as the drive roller. Namely, when the plurality of rollers are receiving load variations of different sizes, by giving precedence to making the roller having the largest effect on image accuracy the drive roller, it is possible to achieve an improvement in image quality.

In FIG. 1, the drive force transmission from the drive source MO1 to the drive roller 12 has been simplified. Specifically, a structure is used in which the roller 12 is linked to the drive source via a roller drive system provided with power transmission unit that uses concave and convex meshing or friction contact and rotation force from the drive source is transmitted to the roller 12 via the roller drive system.

Figure 2A:
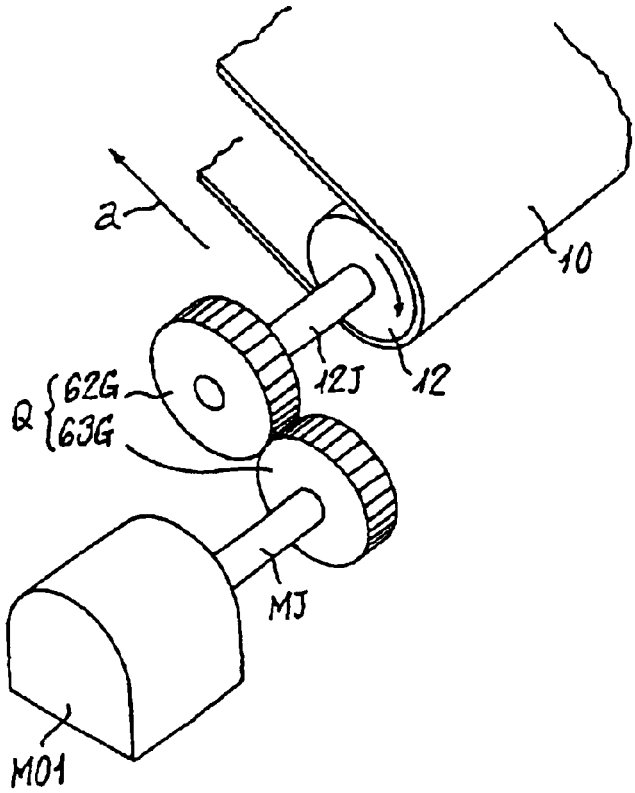
FIG. 2A to FIG. 2C are perspective views each showing an example of the structure of a power transmission unit.

The roller drive system shown in FIG. 2A is formed with a gear 62G fixed to the shaft 12J of the drive roller 12 and a gear 63G that meshes with this gear 62G. The gear 63G is fixed to the shaft MJ of the drive source MO1. In this example, the gear 62G and the gear 63G are taken as the power transmission unit Q.

Figure 2B:
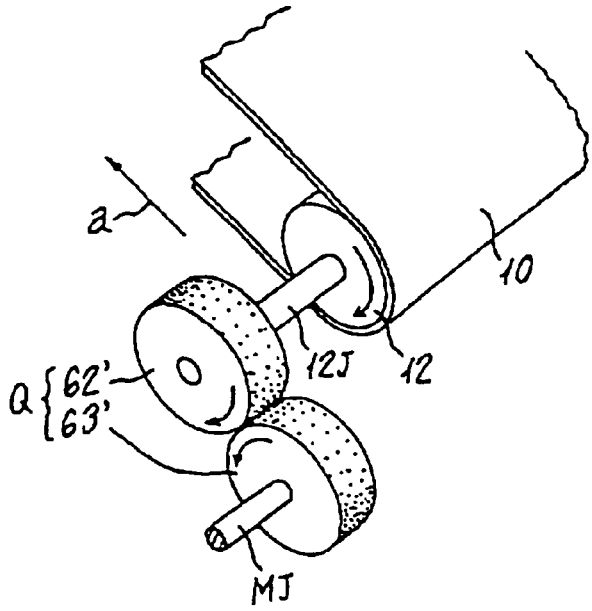

The roller drive system shown in FIG. 2B is formed with a friction gear 62' fixed to the shaft 12J of the drive roller 12 and a friction gear 63' that meshes with this friction gear 62'. The friction gear 63' is fixed to the shaft MJ of the drive source MO1. In this example, the friction gear 62' and the friction gear 63' are taken as the power transmission unit Q.

Figure 2C:
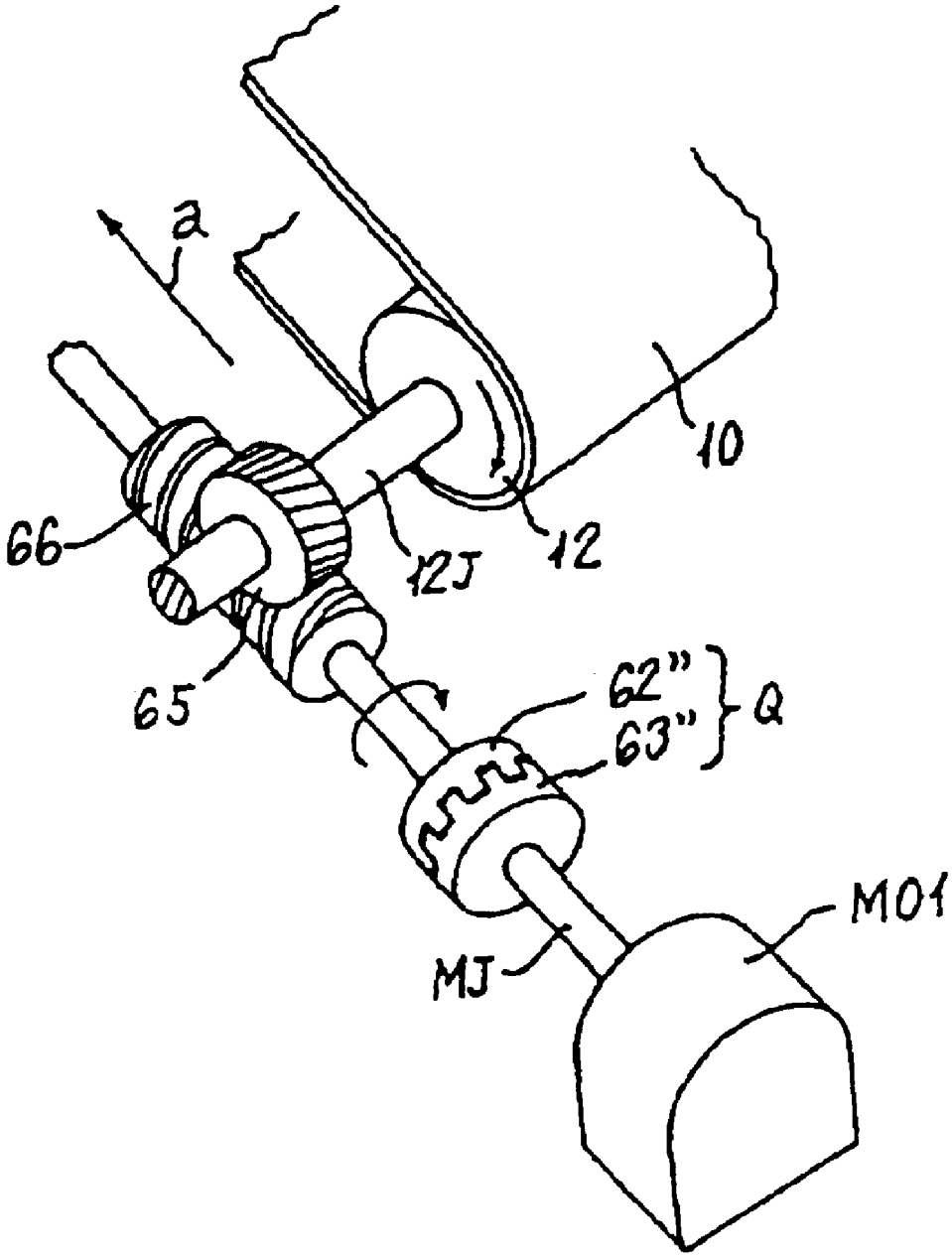

In the roller drive system shown in FIG. 2C, a worm wheel 65 is fixed to the shaft 12J of the drive roller 12 and a worm 66 meshes with this worm wheel 65. A flange 62" having a tooth shaped meshing portion is fixed to the shaft of the worm 66 and a flange 63" having the same tooth shaped meshing portion meshes with the flange 62". The flange 63" is fixed to the shaft MJ of the drive source MO1. The power transmission unit Q is formed by the flange 62" and the flange 63".

Figure 3:
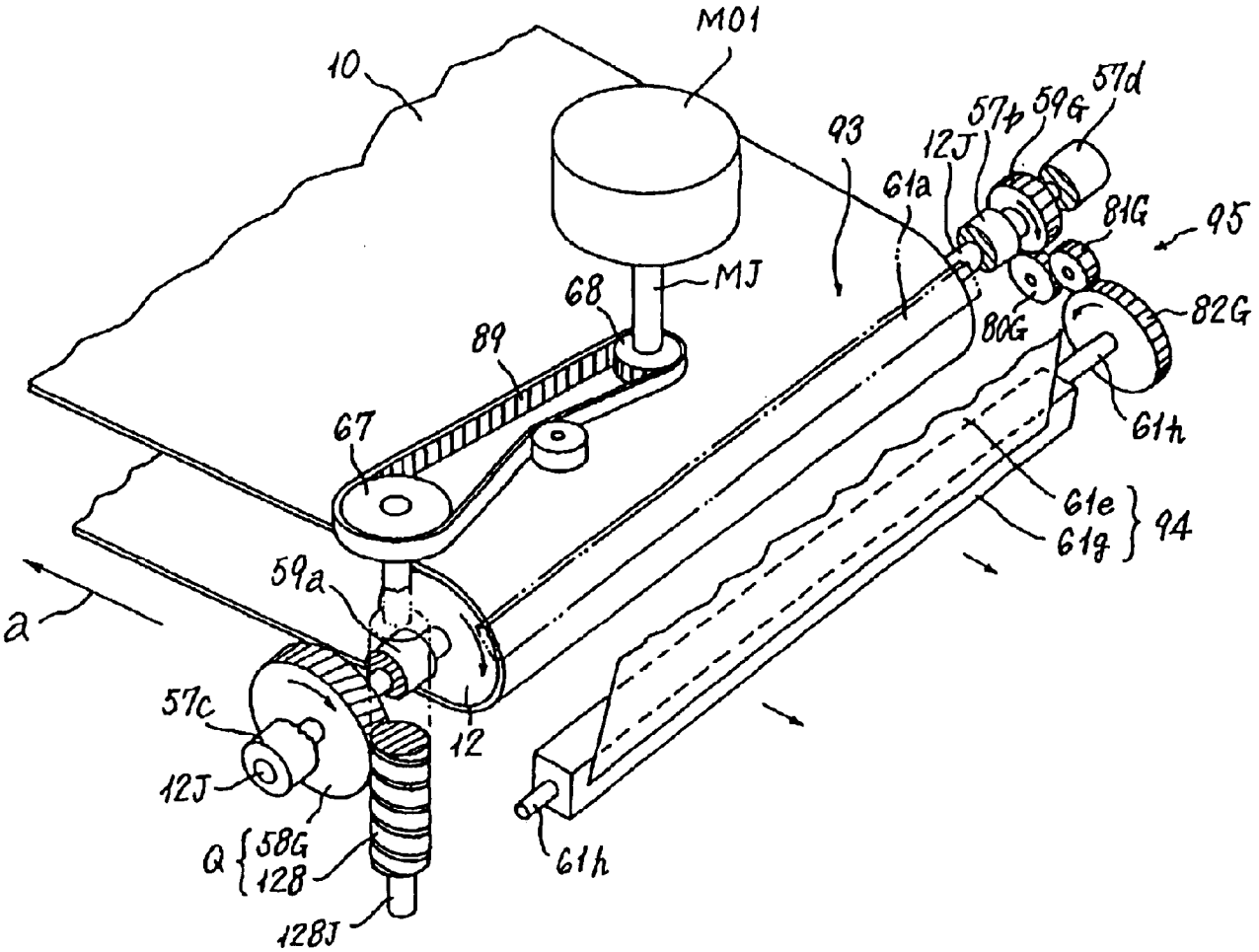
FIG. 3 is a perspective view showing the structure of a cleaning unit and processing drive system.

The roller drive system shown in FIG. 3 is formed by a worm gear 128 meshing with a helical gear 58G fixed to the shaft 12J of the drive roller 12. The shaft 128J that fixes the worm 128 is supported by a not shown bearing and a pulley 67 is fixed to the top portion of the shaft 128J. A belt 89 is entrained between the pulley 67 and a pulley 68 fixed to the shaft MJ of the drive source MO1, and the rotation of the drive source MO1 is transmitted to the pulley 67. In this example, the power transmission system Q is formed by the helical gear 58G and the worm gear 128.

It is possible to use any one of the examples shown in FIGS. 2 and 3 as the roller drive source for driving the drive roller 12. Each of the gears 62G and 63G in FIG. 2A, the flanges 62" and 63" in FIG. 2C, and the helical gear 58 and the worm gear 128 in FIG. 3 are examples of a structure of a power transmission unit using concave and convex surfaces. The friction gears 62' and 63' in FIG. 2B are examples of a structure of a power transmission unit that uses friction contact.

In these examples, the transmission of power can be ensured by the meshing of pairs of gears or by the friction contact of pairs of friction gears. Moreover, the gears can be disengaged in a simple operation merely by moving one meshing gear or one friction gear in a state of friction contact away from the other meshing gear or other friction gear in a state of friction contact, thereby simplifying maintenance.

The cleaning unit 93 provided with the cleaning blade 61*a* and using a drive roller system such as this is set as the processing unit imparting the largest load variation to the roller 12 from among all the processing unit. Moreover, power is imparted to the roller 12 and it is set as the drive roller. The imparted power is set as a drive force of a size which is not affected by the load variation from the cleaning blade 61*a*.

Accordingly, even if the timing of the switching between cleaning and non-cleaning by the cleaning blade 61*a* is superposed with the timing of the image formation on the belt 10 by the photoconductor drums 16 and 26, it is difficult for any pitch shift and color misregistration to occur in the image being transferred onto the belt 10.

Figure 4:
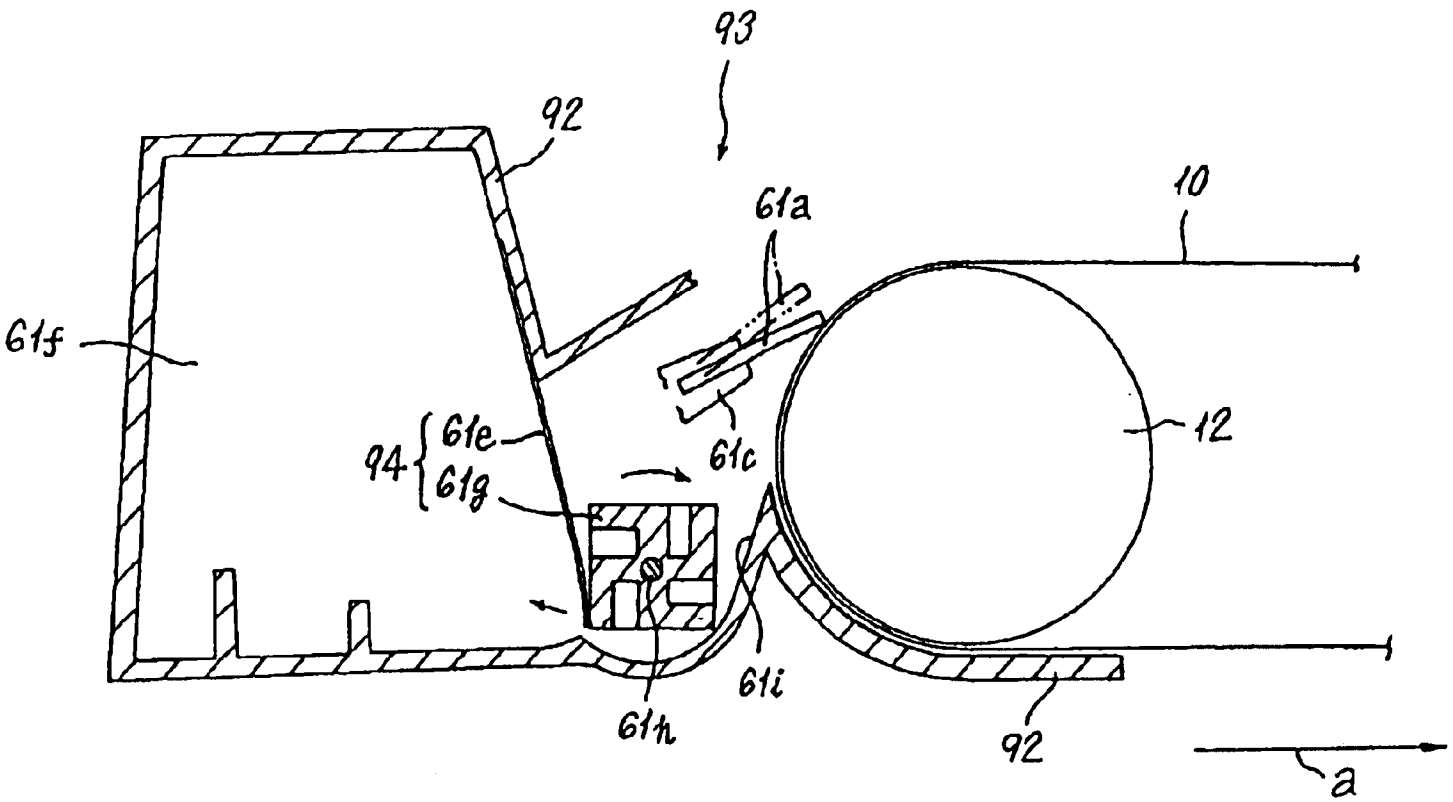
FIG. 4 is a partial front elevational view of a portion of the cleaning unit.
Figure 9A:
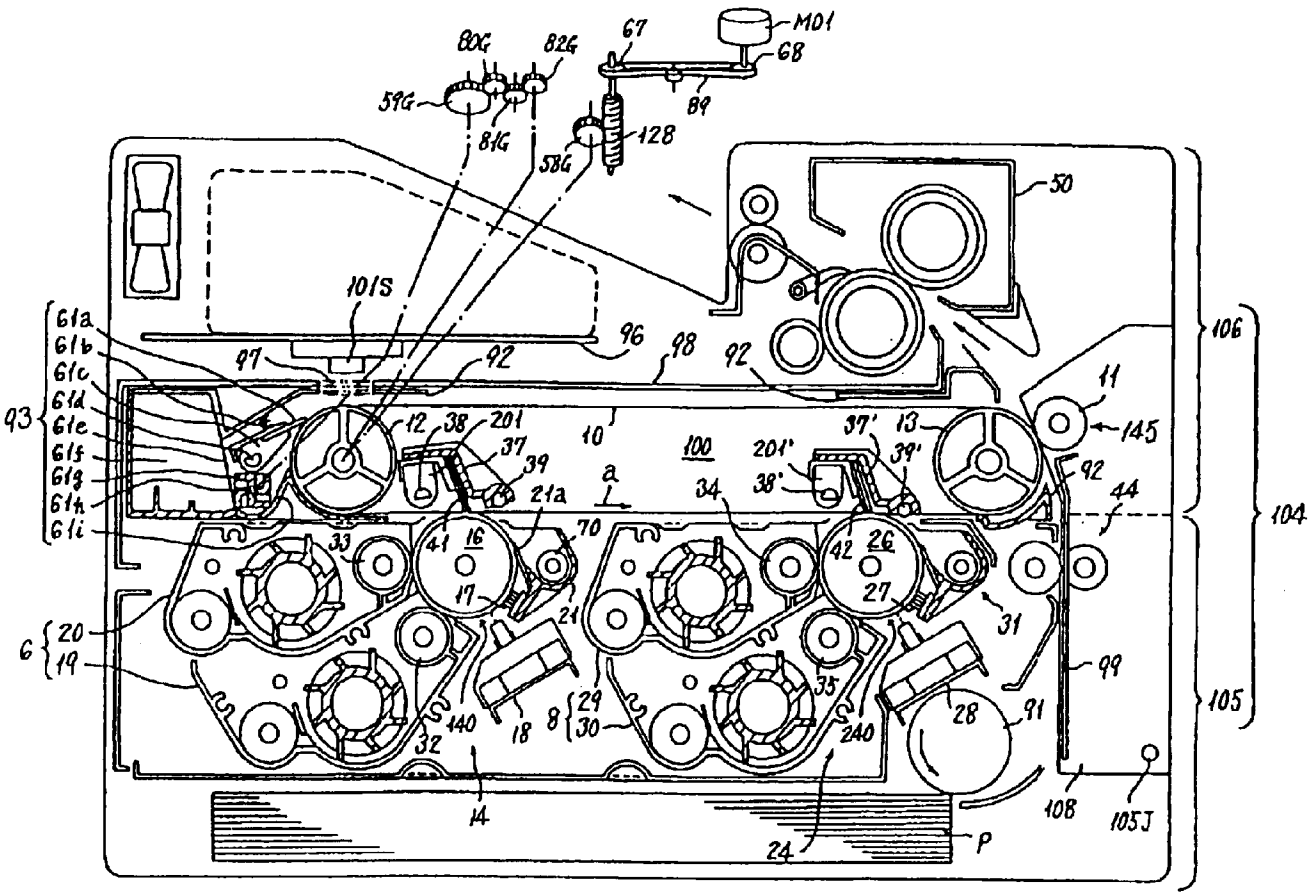

As shown in FIG. 3, 4, and 9A, a cleaning unit 93 is provided in the vicinity of the drive roller 12. The cleaning unit 93 comprises a cleaning blade 61*a* freely movable relative to the belt 10 entrained between the drive rollers 12; a bracket 61*c* supporting the cleaning blade 61*a*; a shaft 61*d* fixed to the bracket 61*c*; a spring 61*b* serving as an example of an elastic unit for urging the bracket 61*c* in the direction in which the cleaning blade 61*a* is being pushed by the belt 10; a guide 61*i* for guiding the paper dust and waste toner scraped off by the cleaning blade 61*a* in a downwards direction; a square pole shaped (whose cross section is formed in the shape of a reversed swastika, as shown in FIG. 4) rotating body 61*g* (which includes a center shaft 61*h*) provided below the cleaning blade 61*a*; a plate spring 61*e* provided such that the free end thereof is in contact with the rotating body 61*g*; and a storage box 61*f* provided on the other side of the rotating body 61*g* from the plate spring 61*e* and serving as a waste developing agent container for receiving waste toner and the like fed on by the rotation of the rotating body 61*g*.

The rotating body 61*g* is supported by the frame 92 so as to be rotatable around the central shaft 61*h*. The proximal end of the plate spring 61*e* is supported by the frame 92. The cleaning blade 61*a* is able to be moved into contact with the belt 10 and away from the belt 10 by the transfer movement unit described below.

The cleaning blade 61*a* and the blade movement unit (described below) for moving the cleaning blade 61*a* relative to the belt 10 form the main elements of the cleaning unit 93.

The cleaning unit is provided with the supplemental processing unit 94 for performing processing to store waste toner from the waste developing agent scraped off the belt 10 by the cleaning blade 61*a* in the storage box 61*e*. This processing unit comprises the rotating body 61*g* and the plate spring 61*e*. The rotating body 61*g* is driven to rotate by the processing drive system 95.

The processing drive system 95 will now be described. In FIG. 3 the fact that the helical gear 58 G is fixed to one end of the shaft 12J has already been described, however, the gear 59G is fixed to the other end of the shaft 12J so that the shaft 12J is supported by the bearings 57*a* and 57*b* that are integral with the frame 92. Furthermore, bearings 57*c* and 57*d* are rotatably mounted at each end portion of the shaft 12J on the outer side of the gear 59G and the helical gear 58G.

The gear 82G meshes with the gear 59G via the idle gears 80G and 81G. The gear 82G is fixed to the central shaft 61*h* of the rotating body 61*g*. The idle gears 80G and 81G adjust the direction of the rotation of the rotating body 61*g* in relation to the direction of the rotation of the belt 10, and also adjust the rotation speed of the rotating body 61*g*.

The processing drive system 95 comprises the gear 82G, the idle gears 80G and 81G, and the gear 59G integral with the shaft 12J and is driven by the power from the roller drive system. Accordingly, there is no need for an independent drive source for the processing drive system 95 enabling the structure to be prevented from becoming more complicated.

Because the blade 61*a* must not be allowed to harm the toner image on the belt 10, it is normally positioned away from the belt 10. The blade 61*a* is placed in contact with and scrapes the belt 10 only at predetermined times when it is supposed to scrape off paper dust and residual toner and the like sticking onto the belt 10 after the transfer onto the paper P in the transfer roller 11 section has been completed.

The combined waste agents consisting of the scraped off paper dust and waste toner fall under their own weight along the guide 61*i* as far as the rotating body 61*g*. The rotating body 61*g* intermittently bends the plate spring 61*e* in accordance with the rotation thereof, thereby feeding the combined waste agents into the storage box 61*f*.

Naturally, the blade 61*a*, the guide 61*i*, the rotating body 61*g*, the storage box 61*f*, and the like including any members supplemental to these occupy a predetermined depth matched to the width of the belt 10 in the vertical direction of the surface of the sheet of paper on which FIG. 4 is drawn. At the point in time when the waste toner collected in the storage box 61*f* reaches a predetermined amount, for example, when the storage box is full, the belt unit 100 (described below using FIG. 5) containing the belt apparatus used in image formation formed integrally with the storage box 61 is replaced.

Figure 5:
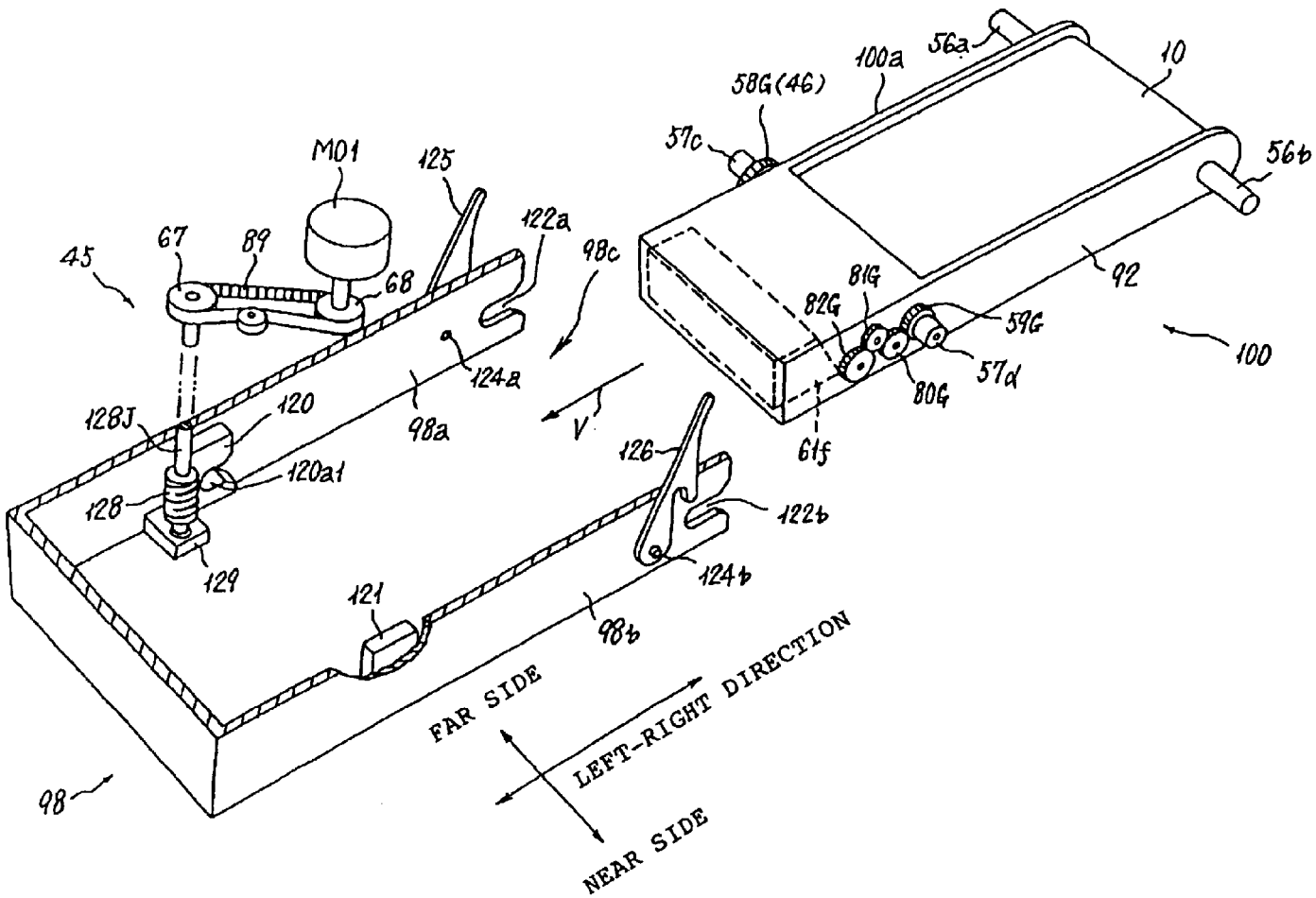
FIG. 5 is an exploded perspective view showing a structure in which a belt unit can be inserted in or removed from a cage body.

As shown in FIG. 5, the belt 10 and the drive roller 12, the roller 13, the transfer roller 11, the first transfer brush 41, the second transfer brush 42, the transfer rollers 39 and 39' (see FIG. 1) that fulfill the auxiliary functions of the transfer brushes 41 and 42, the cleaning unit 93, and the like, which are all supplemental members of the belt 10, are assembled in a flat, box shaped frame 92 having a portion thereof formed as the guide 61*i* and the guide section for the paper. Taken together, these all form the belt unit 100. The belt unit 100 can be inserted in and removed from a cage body which forms a portion of the image forming apparatus body.

Because the belt apparatus used for image formation has been formed as a unit capable of being inserted in and removed from the main body of the image forming apparatus, in this way, it is possible to separate the belt unit containing the belt from the main body when necessary. Therefore, maintenance relating to deterioration due to length of use of the belt 10 is simplified.

The cage body 98 will now be described.

In FIG. 5, the cage body 98 is shown as having a substantially U shaped configuration. The right end portion in the left-right direction (when looking at FIG. 5) is open to form an aperture 98*c*, while the left end portion is closed. The top side is closed by a cover that is connected at a position where hatching has been performed. An angular block-shaped holding member 120 is integrally provided at the inner side of the far side member 98*a* forming the cage body 98.

In the same way, an angular block shaped holding member 121 is also provided at the inside of the near side member 98*b*. The holding members 120 and 121 both have exactly the same shape and size.

An elongated groove 120*a*1 is formed running in the transverse direction in both of the opposite inner side surfaces of the holding members 120 and 121. The right end portion of the grooves 120*a*1 is open to the outside, while the left side portion is closed.

A groove 122*a* is formed at the right end portion in the transverse direction of the far side member 98*a*. The right end of this groove 122*a* is open to the outside. In the same way, a groove 122*b* is formed at the right end portion in the transverse direction of the near side member 98*b*. The right end of this groove 122*b* is also open to the outside. An oscillating lever 125 is provided as a support point for the shaft 124*a* at a position on the far side surface of the member 98*a* and to the left in the transverse direction of the groove 122*a*.

In the same way, an oscillating lever 126 is provided as a support point for the shaft 124*b* at a position on the near side surface of the member 98*b* and facing the lever 125. The levers 125 and 126 have the same size and shape.

A worm 128 is provided extending in the vertical direction at a position to the left of the holding member 120. The worm 128 forms a portion of the roller drive system for driving the belt 10 and is driven to rotate by being linked to the drive source MO1, which is provided at the cover portion of the cage body 98, via the pulleys 67 and 68 and the belt 89 etc. The bottom end portion of the worm 128 is supported by a support member 129 provided integrally with the holding member 120. Because the cage body 98 forms a portion of the body of the image forming apparatus, the drive source MO1, the belt 89, the pulleys 67 and 68, and the worm 128 are taken as the drive system 45 on the body portion side.

The belt unit 100 will now be described.

Because it is difficult to show in FIG. 5 the entire cleaning unit 93 that is shown in FIG. 4 and that is provided in the belt unit 100, only the storage box 61*f* is shown. Although they are not shown in FIG. 5, there are also provided the first transfer brush 41 and second transfer brush 42 and the transfer rollers 39 and 39' shown in FIG. 1.

A bearing 56*a* and a bearing 56*b* for supporting a shaft that is formed integrally with the roller 13 are formed integrally with the frame 92 in the belt unit 100 so as to project outwards to the left and right. Moreover, as was described for FIG. 3, bearings 57*c* and 57*d* for supporting the shaft 12J that is formed integrally with the drive roller 12 protrude to the left and right integrally with the frame 92.

The bearing 57*c* is able to be engaged with the groove 120*a*1 of the holding member 120 provided in the cage body 98, while the bearing 57*d* is able to be engaged with a groove in the holding member 121 (this groove is the same as the grove 120*a*, but is omitted from the illustrations). In the same way, the bearing 56*a* is able to be engaged with the groove 122*a* while the bearing 56*b* is able to be engaged with the groove 122*b*.

The helical gear 58G provided on a portion of the bearing 57*c* and the gear 59G provided on a portion of the bearing 57*d* are both fixed to the shaft 12J of the drive roller 12 and rotate together with the drive roller 12.

Out of the roller drive system described for FIG. 3, the drive source MO1, the belt 89, the pulleys 67 and 68, and the worm 128 are taken as the drive system 45 on the body portion side provided on the cage body 98 side. The remaining helical gear 58G is provided on the belt unit 100 side. Here, the helical gear 58G is taken as the drive system 46 on the unit side.

In this way, the roller drive system is separated into a body portion side and a belt unit side. Moreover, the separation portion has been set as the position of the power transmission unit Q (see FIG. 3), which can be easily attached and removed. Namely, the worm 128 is provided on the body portion side, while the helical gear 58G is provided on the belt unit 100 side.

The worm 128 and the helical gear 58G are able to be easily linked together and separated by using a concave-convex meshing arrangement. Accordingly, it is possible to join or separate the power transmission path formed by the body portion side drive system 45 and the unit side drive system 46 by inserting or removing the belt unit 100 in the cage body 98. The safety of this insertion or removal operation is thus ensured without any special power transmission path joining or separating means being provided.

In accordance with this example, if a structure is employed in the power transmission unit Q shown in each of the examples in FIG. 2A to FIG. 2C in which the roller drive system is divided into a body portion side drive system and a unit side drive system, then the same safety can be ensured in the insertion or removal operation.

In FIG. 5, when the belt unit 100 is fitted into the cage body 98, the storage box 61*f* side of the belt unit 100 is positioned to face the opening 98*c* and from this position the belt unit is moved towards the cage body 98 in the insertion direction shown by the arrow so as to be ultimately installed in the cage body 98.

The body portion side drive system 45 is provided at the far side in the insertion direction shown by the arrow V in the cage body 98. The unit side drive system 46 is also provided at the far side in the insertion direction shown by the arrow V in the belt unit 100. Thus, the power transmission unit Q (see FIG. 3) is formed between the body portion side drive system 45 and the unit side drive system 46.

As a result, it is possible for the worm gear 128 and the helical gear 58G to be linked together (see FIG. 6) thereby allowing power to be transmitted due to the operation of inserting the belt unit 100 in the cage body 98. It is also possible to obtain a state of separation of the worm gear 128 and the helical gear 58G (see FIG. 5) due to the operation of extracting the belt unit 100 from the cage body 98. Thus there is no need for any special linking or separating means.

As shown in FIG. 5, because the body portion side drive system 45 is provided at the far side in the insertion direction shown by the arrow V in the cage body 98, the heavy drive source MO1 is also positioned at the far side. Because the heavy drive source MO1 has been positioned at the far side in this way, in the layout shown in FIG. 8 described below, even when the whole upper case 106 is opened wide around the fulcrum of the shaft 107, the drive source MO1 is located close to the position of the fulcrum simplifying the task of opening the apparatus in order to perform maintenance.

In particular, as in the present example, because a structure that uses a combination of both the worm gear of the body portion side drive system 45 and the helical gear 58G serving as the unit side drive system 46 is employed as the power transmission unit, it is possible to obtain a reliable state of power transmission or a state of non-power transmission easily through the operation of engaging or disengaging the respective gear faces.

As shown in FIG. 5, when loading the belt unit 100 in the cage body 98, the belt unit 100 is moved in the direction of the arrow V from a state in which the storage box 61*f* of the belt unit 100 is facing the opening 98*c*, the bearings 57*c* and 57*d* are engaged with the grooves 120*a*1 of the holding members 120 and 121, at the same time the bearings 56*ac* and 56*b* are engaged with the grooves 122*a* and 122*b*, and, at a position where they strike the furthest side of the grooves, the positional relationships of the photoconduction units 140 and 240, the second developing apparatus 8, and the first developing apparatus 6 shown in FIGS. 1 and 9A are properly set.

Figure 6:
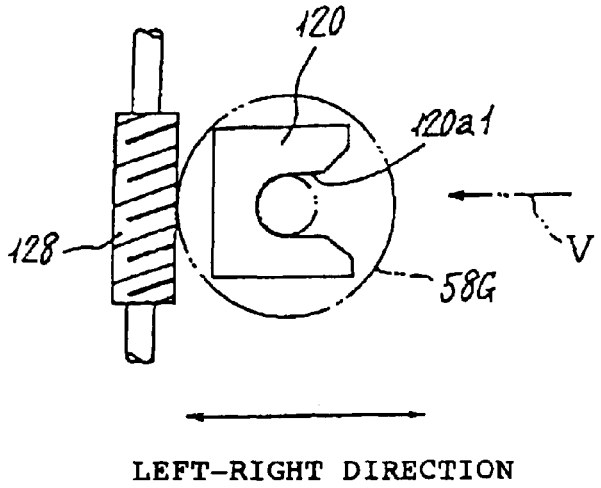
FIG. 6 is a front elevational view showing the meshing relationship between worm and helical gears.
Figure 7:
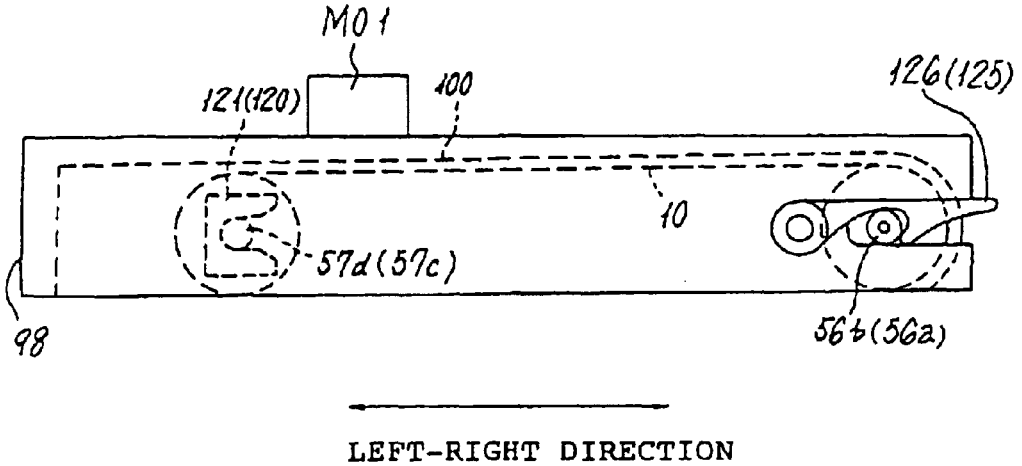
FIG. 7 is a front elevational view showing the state when the belt unit is loaded in the cage body.

At this time, as shown in FIG. 6, the worm gear 128 and the helical gear 58G are in a state of engagement and the power transmission unit Q is in a linked state. In order to hold this position, the bearing 56*b* is held by the lever 126 and the bearing 56*a* is held by the lever 125, as shown in FIG. 7. The distal end portions of the levers 125 and 126 double as handles and by grasping these handles and rotating the levers 125 and 126 in the opposite direction to when the bearings are being held, the state of holding of the bearings 56*a* and 56*b* is terminated.

Figure 8:
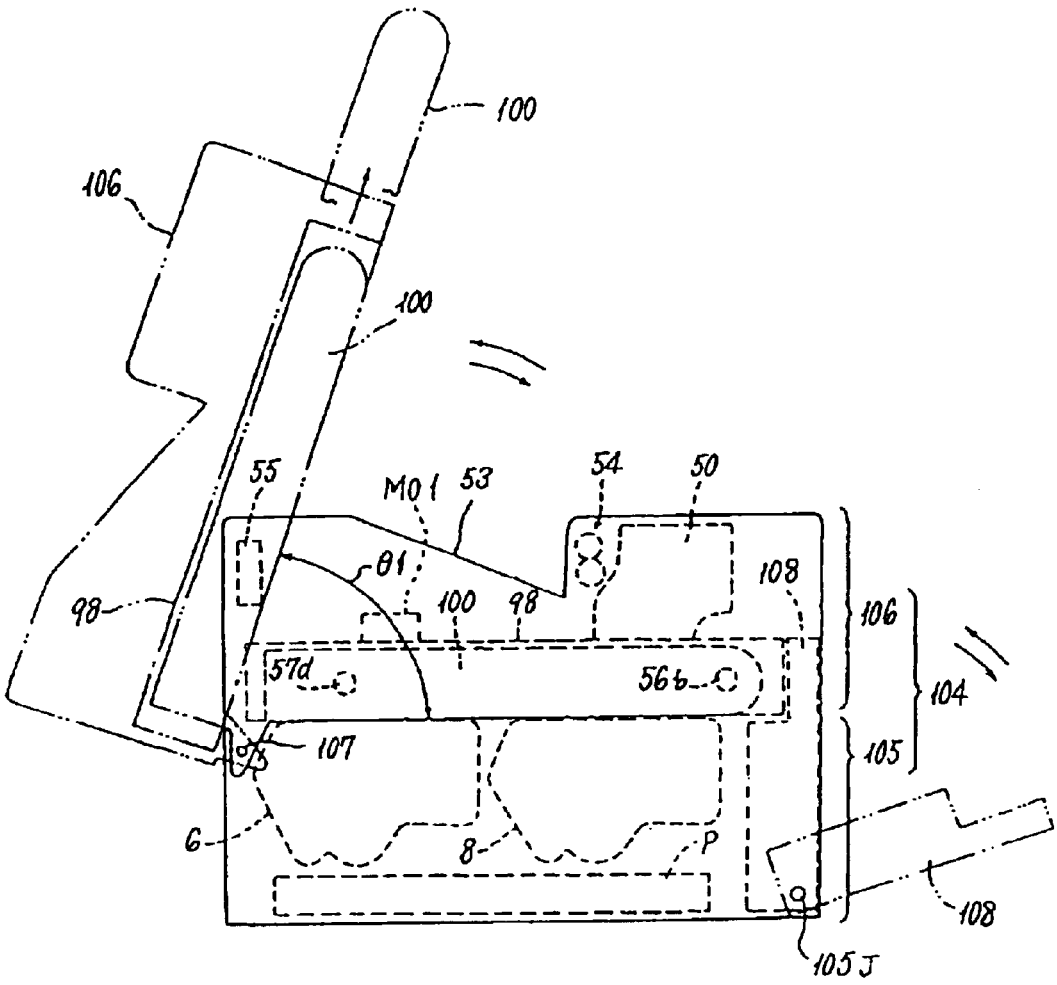
FIG. 8 is a view showing the layout of each unit in an image forming apparatus and the state when the upper case is opened and closed

The overall layout of the image forming apparatus will now be described. In FIG. 8, it can be seen that the entire image forming apparatus is enclosed by an exterior case 104. The exterior case 104 comprises a lower case 105 housing the first developing apparatus 6, the second developing apparatus 8, other members, and the paper P which is placed thereon, and an upper case 106 provided with the belt unit 100, a fixing apparatus 50, a pair of paper discharge rollers 54, an exhaust fan 55, parts of the electrical system, other materials, and a paper discharge tray 53.

The upper case 106 is pivotally mounted to the lower case 105 by the shaft 107 at the end portion of the lower case 105 where the first developing apparatus 6 is positioned in the transverse direction as seen in FIG. 8. In order to allow access during general maintenance or replacement of the various parts housed in the upper case 106 and lower case 105, after the cover 108 has been opened, the upper case 106 can be opened wide from the lower case 105 around the shaft 107, as shown by the double dot dash lines. The upper limit of the opening angle θ1 is set in the present example at 70° after considering the operability of the opening and closing operation.

The removal of the belt unit 100 from the cage body 98 may be performed by, looking at in FIG. 8, opening the cover 108 and then lifting the upper case 106 to the position shown by the double dot dash lines. The levers 125 and 126 are then operated from the state shown in FIG. 7 so as to release the bearings 56*a* and 56*b*, thereby allowing the belt unit 100 to be removed from the cage body 98. This process is reversed when inserting the belt unit 100 into the cage body 98.

Figure 17A:
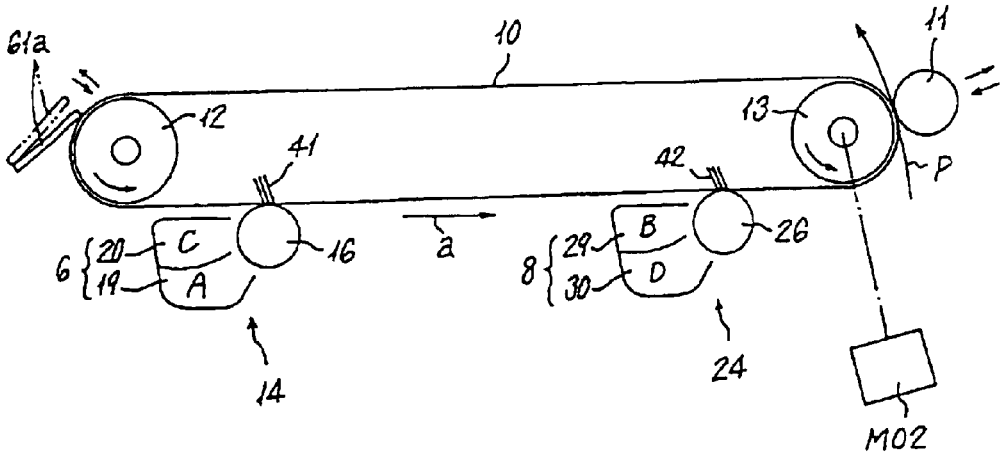
FIG. 17A (PRIOR ART)

(2) Image Forming Apparatus:

In FIG. 17A, a portion of the belt apparatus used in image formation and the related processing unit for image formation was described. In FIG. 8, the overall layout of the image forming apparatus in which the belt apparatus used for image formation was installed was described. The structure and operation of this image forming apparatus will be described.

In the image forming apparatus described below, the image forming apparatus disclosed in JP-A No. 10-177286 is formed into an image forming apparatus capable of providing an even higher quality color image by stabilizing and improving the accuracy of the various sensors of the belt while also improving the intermediate transfer efficiency onto the belt that is serving as an intermediate transfer body. However, the present example can be applied not only to the image forming apparatus disclosed in JP-A No. 10-177286, but also to any apparatus provided it an image forming apparatus that uses a belt as an intermediate transfer body. The present example enables the transfer efficiency to be improved and the sensing accuracy to be improved and stabilized at the same time using a simple structure.

The present invention is provided with a belt serving as an intermediate transfer body and a plurality of image forming units and is most effective when applied to an image forming apparatus structured such that the intermediate transfer unit moves towards or away from the belt.

In the image forming apparatus of the present example, a plurality of developers for different colors are lined up in sequence around the photoconductor drum, however, instead of this type of structure, it is also possible to use what is known as a rotary developing apparatus in which the plurality of developers for different colors are arranged in a radial pattern around the rotation shaft, allowing the transfer efficiency to be improved using a simple structure.

In FIG. 9A, as has already been described for the belt unit 100, the belt 10 is entrained between the drive roller 12 and the roller 13 and moves in the direction shown by the arrow a. The belt unit 100 is formed from the first transfer brush 41, the second transfer brush 42, the transfer roller 11 serving as the final transfer unit, the cleaning blade 61*a*, the rotating body 61*h*, the plate spring 61*e*, the storage box 61*f*, and the various members supplemental to these. The transfer roller 11 faces the roller 13 and is the final transfer unit for transferring the toner image on the belt 10 onto the paper P. The transfer roller 11 is provided so as to be able to move in a direction towards or away from the roller 13 with the belt 10 between the two rollers.

In the conventional technology as disclosed in JP-A No. 10-177286, the bottom side traveling surface of the belt 10 was set as the tensioned side, however, in the present example, the bottom side traveling surface is set as the non-tensioned side. Moreover, in the present example, the first image forming unit 14 and the second image forming unit 24 are provided at a fixed interval on the bottom side traveling surface of the belt 10, namely, on the extended surface of the belt which becomes the non-tensioned side when the drive roller 12 is driven along the traveling direction of the belt 10 as shown by the arrow a. The belt 10 is formed at a length several integers longer than the circumference of the drive roller 12, and is longer by the amount of the non-image areas than the length in the direction of movement of the maximum size of paper that can be used in the image forming apparatus in the present example.

Namely, the roller 12 is set as the drive roller and the roller 13 is set as the slave roller so that the bottom side extended surface becomes the non-tensioned side when the roller 12 is driven. In other words, by setting the roller 12 as the slave roller, the bottom side extended surface becomes the non-tensioned side, and the first image forming unit 14 equipped with the photoconductor drum 16 and the second image forming unit 24 equipped with the photoconductor drum 16 are provided at the bottom side of the intermediate transfer belt 100 so as to face the extended surface of the non-tensioned side.

Because the apparatus is structured in this way, even there is a variation in the load imparted to the drive roller 12 by the cleaning blade 61*a*, the effect thereof does not reach the belt 10. Therefore, naturally, there is no pitch unevenness or color misregistration in the intermediate transferred toner image, which is a conspicuous image. Moreover, because the image forming unit 14 and 24 are provided on the extended surface of the belt which is the non-tensioned side, the photoconductor drums 16 and 26 and the belt 10 can be brought into contact with each other over a sufficient contact width so as to enable intermediate transfer using only a small amount of force. As a result, there is an improvement in the transfer efficiency and stable transfer is made possible, thereby providing an improvement in image quality.

Figure 10A:
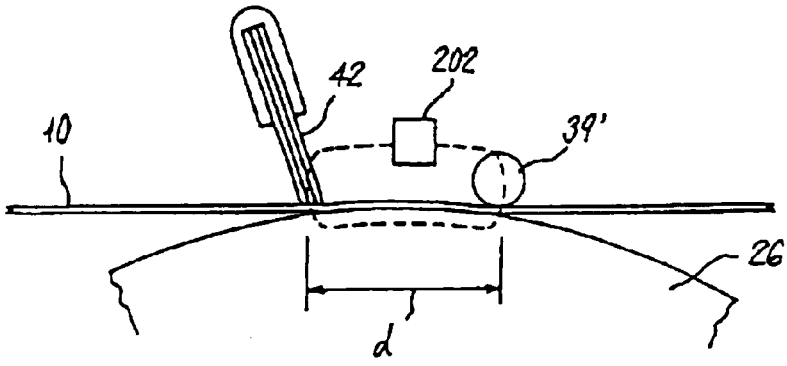
Figure 10B:
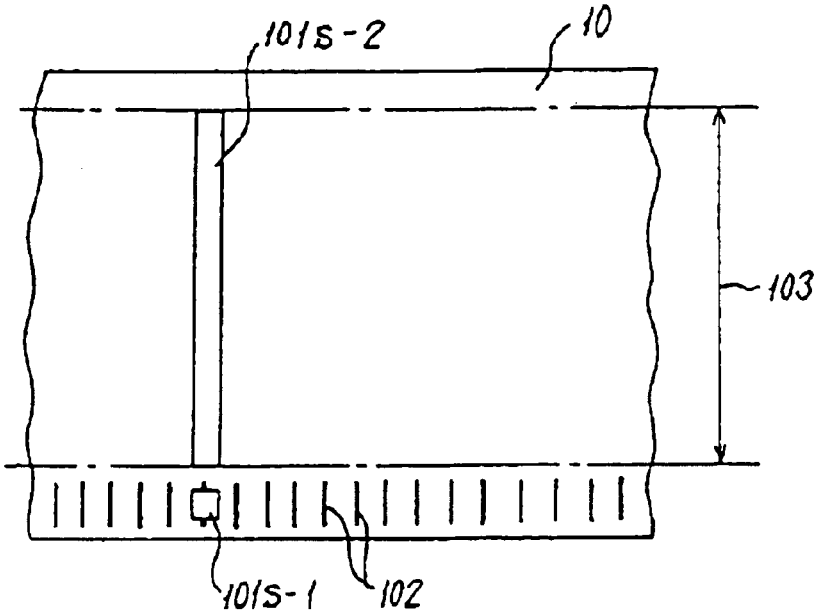
FIG. 10B is a partial plan view of the belt vicinity showing the placement of the detecting unit.

In the present example, as has already been explained with respect to FIG. 1, FIG. 9A, and FIG. 10B, the roller 12 is set as the drive roller, the roller 13 is set as the slave roller, and the belt 10 is rotated in the direction shown by the arrow a so that, when driven, the surface of the belt 10, namely, the lower side extended surface becomes the non-tensioned side.

In other words, by setting the roller 12 as the drive roller, when driven, the bottom side extended surface becomes the non-tensioned side, and the first image forming unit 14 and the second image forming unit 24 are placed at the bottom side of the belt 10 so as to face the non-tensioned side extended surface. Consequently, the location of a photosensor that is positioned as a sensing unit for detecting the position of the belt 10 is restricted.

Namely, in the above structure, because the upper side extended surface of the belt 10 is set as the tensioned surface, the sensing unit 101S is provided so as to face this tensioned side extended surface. A mark sensing photosensor 101S-1 for reading marks printed on the belt 10 and a density sensor 101S-2 for detecting the density of the toner image on the belt 10 and the like can be used as the sensing unit 101S. These sensors are positioned above the belt 10 with the light emitting and light receiving surfaces thereof facing downwards opposite the upper side extended surface of the belt 10 which is the tensioned side. The photosensor 101S-1 and the density sensor 101S-2 are included as the sensing unit 101S and, in the description below, these sensors will all be described simply as the sensing unit 101S.

The position where the sensing unit 101S is located at the tensioned side extended surface of the belt 10 will now be further described. The position of the sensing unit 101S in the main scan direction (i.e. in the transverse direction of the belt) differs depending on the objective of the sensing. For example, if the sensor is the belt mark sensor 101S-1 for sensing marks printed on the belt 10 in order for the rotational position of the belt 10 to be detected, the sensor 101S-1 is placed in the vicinity of the edge of the belt in the transverse direction thereof to match the position of the marks. In the present example, as shown in FIG. 10B, the marks are outside the image formation area 103, and the belt mark sensor 101S-1 is placed at a position facing the area transited by the reflective marks 102 printed at equal intervals on the belt 10 in the direction of rotation thereof.

If the sensing unit 101S is the density sensor for detecting the density of the image formed on the belt 10, the density sensor 101S-2 is placed so as to face the entire image forming area 103, as shown in FIG. 10B at a position facing the toner density patterns formed in each color on the belt 10. Note that, the density sensor 101S-2 requires the same number of photosensors as there are colors when the pattern position is changed for each color.

As regards the position of the sensing unit 101S in the sub scan direction (i.e. in the rotational direction of the belt), regardless of the purpose of the detection, all sensing unit, in this case, both the belt mark sensor 101S-1 and the density sensor 101S-2 use photosensors and these photosensors are positioned slightly away from a contact point E (an end of the contact portion) where the drive roller 12 and the slave roller 13 contact the belt 10 and at the upper side extended surface which is the tensioned surface of the belt 10. This is because this is a position at which the effects of sagging and vibration are minimal from the point E which is the end of the contact portion for a distance of approximately 10 mm.

Figure 9B:
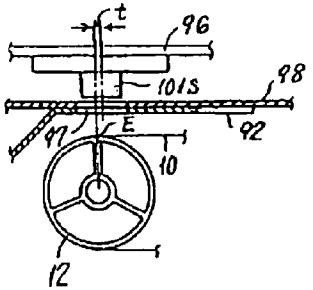
FIG. 9B is a partial front elevational view of the vicinity of the belt showing the placement of the detecting unit.

In FIG. 9B, the sensing unit 101S is placed at a position where t=5 mm from an optional roller out of the plurality of rollers forming the extended surface on the tensioned side of the belt 10, namely, the rollers 12 and 13, for example, if the drive roller 12 is taken as a reference, then 5 mm from the drive roller 12. By setting a position that is slightly removed from the optional roller as a reference position, it is possible to sufficiently guarantee and improve the accuracy of the various detections using a simple structure without using special parts or performing the detection at the curvature portion.

Moreover, in the present example, the sensing unit 101S is positioned on the tensioned side extended surface slightly upstream in the rotation direction of the belt 10 from plurality of rollers, for example, the drive roller 12. As a result, it is possible to improve even further the accuracy of the detection by the sensing unit 101S.

Furthermore, if t is set at a distance of 5 mm, because it is possible to keep the effects of vibration or sagging in the belt 10 to a minimum amount without there being any particular accuracy requirements for the mounting in this area, this position is recommended as being able to guarantee a sufficient detection accuracy.

In the above example, the sensing unit 101S is placed at a position close to the drive roller 12, however, if the photosensor of the sensing unit 101S is facing downwards at the tensioned side of the belt 10, it is possible to obtain the same operational effect if the sensing unit is placed at a position near the slave roller 13. Moreover, from the standpoint of the structure of the apparatus, there is no reason why a plurality of photosensors cannot be placed at different positions, however, for reasons of ease of assembly, number of parts, cost, and so on, it is more advantageous if the photosensors are centered at the side of one roller or the other. Further, if greater accuracy is required in the detection, then it is better if the photosensors are placed at a position near the drive roller 12, which has a better drive response and is less affected by elongation of the belt 10, as shown in FIGS. 1, 9A, and 9B.

The apparatus structure of the image forming apparatus shown in FIG. 9 is formed with at least the following elements stacked up in the following order in a vertical direction from the bottom: namely, 1—the first image forming unit and second image forming unit station 24; 2—the belt unit 100; 3—an engine circuit board 96 for performing control such as the operating of the various members used for forming an image in the relevant image forming apparatus. In the apparatus structure of this image forming apparatus, the first image forming unit 14 and second image forming unit 24 are housed in the lower case 105, while the belt unit 100 and the engine circuit board 96 are housed in the upper case 106 (this is described below).

In FIG. 9A, the sensing unit 101S is electrically connected with the engine circuit board 96. Moreover, as shown in FIGS. 9A and 9B, the sensing unit 101S is mounted looking downwards at the engine circuit board 96 that is fixed to the upper case 106, and is placed so as to look at the belt 10 via an aperture 97 formed commonly in the frame 92 and cage body 98 that is formed integrally with the upper case 106. Alternatively, although not shown, it is also possible to provide the sensing unit 101S mounted directly on the cage body 98 such that it looks at the belt 10 via the aperture 97 formed in the frame 92.

Whichever structure is employed, the sensing unit 101S is not mounted on the belt unit 100 side which is a removable member, but is provided on the upper case 106 side. As a result, when removing or inserting the belt unit 100, which is a replaceable part, in the apparatus body because its usability has ended or because it is full of waste toner, there is no need to take special care of the sensing unit 101S and there is no concern that the sensing unit 101S will be discarded together with the belt unit 100.

As described above, because the sensing unit 101S is positioned above the position where toner is present such as in the first image forming unit 14 and the second image forming unit 24, and because between the sensing unit 101S and these image forming unit is blocked by the cage body 98, apart from the aperture 97 where the belt unit 200 is interposed, it is possible to completely prevent toner splashes from the first image forming unit 14 and the second image forming unit 24.

Moreover, because the light emitting and light receiving surfaces of the photosensors of the sensing unit 101S are placed so as to face downwards, toner contamination of the light emitting and light receiving surfaces due to toner spillages and splashes from the belt 10 can also be kept to the barest minimum. These advantages also apply in the case of the engine circuit board 96 as well as to the sensing unit 101S, and it is possible to prevent short circuiting and erroneous electrical operation caused by toner because contamination of the engine circuit board 96 can be avoided. Furthermore, if consideration is given to ease of assembly, it is preferable if the sensing unit 101S is first mounted facing downwards on the engine circuit board 96 and then this engine circuit board 96 is mounted on the upper case 106.

Note that the sensing unit 101S is formed from at least one of the photosensor 101S-1 used for mark detection or the toner density sensor 101S-2 which serves as a toner density detecting unit and, normally, both are provided, as shown in FIG. 10B (such a detailed structure is not shown in FIG. 1 and FIG. 9). In some cases, an electric potential sensor for measuring the residual electric potential in the belt 10 is also provided, however, as described above, even if the positions of these sensors are different in the main scanning direction, their positions in the sub scanning direction are set as the same position. Because this allows costs to be reduced as a result of the wiring pattern being simplified, it is extremely advantageous from the standpoint of the creation of the engine circuit board 96.

The first image forming unit 14 is mainly formed from a brush shaped static electrifier 17 for uniformly electrifying the surface of the photoconductor drum 16; a writing unit 18 for writing on the electrified surface of the photoconductor drum 16 using a beam that is modulated by image signals that are based on an original; a A color developer 19; a C color developer 20; and a cleaning unit 21. The first developing apparatus 6 is formed from the A color developer 19 and the C color developer 20. The symbols 32 and 33 indicate developing rollers for supplying toner in the respective colors to the photoconductor drum 16.

The second image forming unit 24 comprises the same structure as the first image forming unit 14 and is equipped with the photoconductor drum 26; a static electrifier 27; a writing unit 28; a B color developer 29; a D color developer 30; and a cleaning unit 31. The B color developer 29 and the D color developer 30 form the second developing apparatus 8. The second image developing unit 24 is installed in the apparatus body in the same attitude as the first image developing unit 14.

A plurality of developers are integrated in each of the developing apparatuses 6 and 8 of the present example and the positions thereof are fixed relative to the photoconductor drums 16 and 26, however, depending on the image formation method, it is also possible to provide moving unit for each of the plurality of developers so that they can be moved relative to the photoconductor drum 16.

In the present example, the belt 10 is extended so that, of the extended belt surfaces, both the non-tensioned side and the tensioned side, which together form the two extended belt surfaces, are substantially parallel at least when the driver roller 12 is being driven. Namely, the diameters of the drive roller 12 and the roller 13 are made the same and, other than these rollers, no tension roller is provided that might unduly deform the usual shape of the belt 10.

Conventionally, another tension roller is provided in elastic contact with the belt between the two facing rollers so as to keep the belt tension constant. Because the usual shape of the belt then becomes a triangular shape, the structure around the belt needs to be enlarged. However, in the present example, because the roller that is affected by the load variation from the cleaning blade 61*a* is the set to be the drive roller, the belt tension can be kept constant without a conventional tension roller needing to be provided.

Accordingly, if the diameters of the drive roller 12 and the roller 13 are equal, it is possible to keep the tensioned side and the non-tensioned side substantially parallel, and it is also possible to reduce both the width and the size of the belt unit 100 giving it a compact box-like shape with no large holes or protrusions. Moreover, the task of replacing the belt is simplified contributing to the reduced size of the apparatus. Note that, in the example shown in FIG. 9A, the belt 10 is placed with a horizontal attitude, however, the present invention is not limited to this and it is also possible to for the belt to be given a vertically elongated attitude or a diagonal attitude.

The first image forming unit 14 and the second image forming unit 24 are positioned at a fixed interval in the traveling direction (i.e. rotation direction) of the belt 10 at the extended surface on the lower side of the belt 10. Moreover, as was described above, the sensing unit 101S is provided at a position slightly away from the drive roller 12 at the upper side extended surface, and sensors having different purposes such as detecting marks and density, namely, the photosensor 101S-1 and the density sensor 101S-2 are placed substantially in a row in the main scanning direction.

In FIG. 9A, a photoconduction unit 140 is formed from the photoconductor drum 16, the static electrifier 17, and the cleaning unit 21 in the image forming unit 14. In the static electrifier 17, a roller type of static electrifier is used in place of a brush type of static electrifier.

The developer 6, the photoconduction unit 140 and the writing unit 18 are each provided so as to be able to be freely inserted in and removed from the apparatus body. The cleaning unit 21 has a cleaning blade 21*a* whose length in the transverse direction is of a size that covers the whole photoconductor drum 16.

The waste toner scraped off by the cleaning blade 21*a* is ejected past the end of the photoconduction unit 140 by the rotation of a screw conveyor type auger 70 and is collected in a not shown waste toner collection box.

In the present example, the cleaning blade 21*a* and the static electrifier 17 are normally in contact with the photoconductor drum 16 in the photoconduction unit 140, however, because of the image forming method and in order to prevent toner from adhering and to prevent curling, the cleaning blade 21*a* and the static electrifier 17 may be provided with a moving unit so that they can be moved relative to the photoconductor drum 16.

In the second image forming unit 24, the photoconduction unit 240 is formed from the photoconductor drum 26, the static electrifier 27, and the cleaning unit 31. The developer 8, the photoconduction unit 240 and the writing unit 28 are each provided so as to be able to be freely inserted in and removed from the apparatus body.

The second image forming unit 24 has the same shape and structure as the first image forming unit 14. The only point of difference is the color of the developers, namely, the B color developer 29 develops in the color B, while the D color developer 30 develops in the color D. The symbols 34 and 35 indicate developing rollers for supplying toner in the respective colors to the photoconductor drum 26.

The second image forming unit 24 is installed in the apparatus body in the same attitude as the first image developing unit 14. The first image forming unit 14 and the second image forming unit 24 are both able to be freely inserted in and removed from the apparatus body. The rotation of the photoconductor drums 16 and 26 is synchronized with the traveling of the intermediate transfer belt 10 and the linear speed thereof is also set to match the traveling with a high degree of accuracy.

A first and second brush shaped transfer apparatuses 41 and 42 are removably provided on the opposite side of the belt 10 respectively from the photoconductor drums 16 and 26 as the intermediate transfer unit. The brush shaped transfer apparatus will be described in detail in the first image forming unit 14. Namely, the first transfer brush 41 and an insulating holder 37 are fixed to a bracket 201. The bracket 201 is rotatably supported at the frame 92 (see FIGS. 4 and 12), which forms a side plate of the belt unit 100, by a shaft 38 that is fixed to the bracket 201. The shaft 38 forms a part of the transfer movement unit that is described below.

By controlling this transfer movement unit, the holder 37 is oscillated together with the rotation of the bracket 201. A transfer roller 39 which serves as a second transfer unit is rotatably provided on the holder 37 at a position slight away from the first transfer brush 41.

The first transfer brush 41 and the transfer roller 39 may be provided so as to be constantly in contact with the belt 10, however, in the present example, in order to avoid curling and wear of the transfer brush and toner adherence, the oscillation angle of the bracket 201 is controlled so that the first transfer brush 41 and the transfer roller 39 are only in contact with the belt 10 during the intermediate transfer process for transferring the toner image on the photoconductor drum 16 onto the belt 10.

Therefore, other than in the intermediate transfer process, the first transfer brush 41 and the transfer roller 39 are positioned out of contact with the belt 10. Note that, at this time, the belt 10 is also positioned slightly away from the photoconductor drum 16. It is also possible to use a roller type of apparatus for the intermediate transfer mechanism in place of the transfer brush 41.

During the intermediate transfer, the belt 10 that was positioned away from the photoconductor drum 16 is placed in contact with the photoconductor drum 16 by the first transfer brush 41 and the transfer roller 39. Because the transfer will not be performed properly if the contact is only minimal, it is necessary for the belt 10 and the photoconductor drum 16 to be in contact for a reasonably extensive amount.

Therefore, the belt 10 is bent downwards by the first transfer brush 41 and the transfer roller 39 (it is actually mainly the transfer roller 39 that performs this task) so that the first transfer brush 41 pushes the belt 10 sufficiently onto the photoconductor drum 16 and the belt 10 is wound onto the photoconductor drum 16 by the transfer roller 39.

By using this structure, it is possible to obtain sufficient contact width of the belt 10 with the photoconductor drum 16. In order to obtain this sufficient contact width, the transfer movement unit needs to have enough force to bend the belt 10 downwards, enough force to push the first transfer brush 41 onto the photoconductor drum 16, and enough force to wind the belt 10 onto the photoconductor drum 16. These forces need to be at least larger than the tension on the belt 10.

As in the present example, when a plurality of image forming units, such as the first image forming unit 14 and the second image forming unit 24, are provided, an extremely large force is required because the amount of bending of the belt 10 increases with the number of image forming units provided. The movement operation relative to the photoconductor drum 16 performed by bending the belt 10 at the tensioned side extended surface of the belt 10 in the conventional technology, as described in JP-A No. 10-177286, requires even greater force.

Therefore, in the present example, as is described for FIG. 11 and FIG. 12 below, the movement operation to bend the belt 10 is performed at the extended surface on the non-tensioned side of the belt 10 by the transfer movement unit. There is a marked difference between the tensioned side and the non-tensioned side in the force necessary to bend the belt 10 and it is advantageous for the movement operation to be performed at the non-tensioned side. According to the present example, it is possible to make the force necessary to perform the movement operation as small as possible while a sufficient contact width is obtained with this small force and an improvement in the transfer efficiency and transfer stability are obtained.

Furthermore, in the structure of the present example, because a space is thus providentially opened up on the tensioned side extended surface of the belt 10 for the detection by the sensing unit 101S, it is possible for the photosensor to be placed trouble free at the desired position.

The peripheral structure and operating functions of the second transfer brush 42 are the same as those of the above described first transfer brush 41 and the mark—'—is added to the symbol of the corresponding member shown in FIG. 9A and a description thereof is omitted here. These members are the holder 37', the shaft 38', the transfer roller 39', and the bracket 201'.

However, the timing at which the second transfer brush 42 and the transfer roller 39' are moved towards or away from the belt 10 in the intermediate transfer process are different. In FIG. 9A, the first transfer brush 41 and the transfer roller 39 are positioned away from the belt 10 while the second transfer brush 42 and the transfer roller 39' are positioned in contact with the belt 10.

As shown in FIG. 9A, by leaving a gap between the second transfer brush 42 and the transfer roller 39', it is possible to bring the belt 10 into contact with the photoconductor drum 26 over predetermined width when the two are in a state of contact. In this state, if an electric potential difference is given to the second transfer brush 42 and the roller 39' and a bias voltage is applied, then, as shown in FIG. 10A, it is possible to form a bias circuit running from the bias power supply 202—the second transfer brush 42—the belt 10—the photoconductor drum 26—the belt 10—the transfer roller 39'—the bias power supply 202. It is thus possible to improve the transfer performance as well as provide a nip width between the transfer roller 39' and the second transfer brush 42 where the gap d has been provided. The transfer roller 39' may be connected to the ground.

Because the intermediate transfer unit is formed from two members with a gap provided therebetween, namely, the second transfer brush 42 and the transfer roller 39', it is possible to form a current circuit traveling around the photoconductor drum via the belt 10 using the width between the members and, by effectively causing this to act on the transfer bias, to increase the transfer efficiency. This point is the same for the first transfer brush 41 and the transfer roller 39. Note that it is also possible to provide a plurality of transfer rollers that are supplemental to the transfer brushes 41 and 42.

Even if there are a plurality of image forming unit, the force necessary to perform the movement operation of the intermediate transfer unit relative to the photoconductor drum can be markedly less than when the contact is med by the tensioned side extended surface of the belt 10 (i.e. as in the conventional example disclosed in JP-A No. 10-177286). Moreover, the practicality thereof increases as the number of the image forming units increases.

Moreover, when the first transfer brush 41 and the transfer roller 39 or the second transfer brush 42 and the transfer roller 39' are being moved as described above, the extended surface on the non-tensioned side of the belt 10 bends so that a predetermined width thereof comes into contact with the photoconductor drums 16 and 26, however, because the extended surface on the tensioned side is always being pulled by the drive roller 12 when it is being driven, there is practically no deformation or variation from sagging. Moreover, as in the present example, the closer the position is to the drive roller 12, the more advantageous it is in the detection by the sensing unit 101S.

The transfer roller 11 used for the final transfer when the toner image on the belt 10 is transferred onto the paper P is provided in a freely rotatable manner facing the slave roller 13 with the belt 10 between the two rollers, thereby forming the final transfer section 45.

In FIG. 9A, a description was given of the cleaning unit and the supplemental members thereof that are positioned facing the drive roller 12 and are used for removing and collecting residual toner and the like on the surface of the belt 10, therefore, as the same legends are allocated in this figure as well, a description of these is omitted here.

The blade moving unit for moving the cleaning blade 61*a* towards or away from the belt 10 is described using FIGS. 4 and 11, however, an outline thereof will be given here. In FIG. 9A, the cleaning blade 61*a* is supported by a bracket 61*c* which forms a portion of the blade moving unit. The bracket 61*c* is rotatable supported at the frame 92 (see FIG. 12) of the belt unit 100 by a shaft 61*d*. The shaft 61*d* is linked to the blade moving unit.

By controlling the blade moving unit, the bracket 61*c* can be rotated against the urging force of a spring 61*b*. The direction of this rotation is the direction in which the cleaning blade 61*a* is separated from the belt 10. The blade moving unit can either maintain this separated state or, as shown in FIG. 9A, the rotation force of the blade moving unit can be terminated and the urging force of the spring 61*b* can be used to place the cleaning blade 61*a* in contact with the belt 10.

Because it is necessary to keep the belt 10 always clean, the cleaning blade 61*a* is usually in contact with the belt 10. However, during the intermediate transfer processing using the first transfer brush 41 and the like, it is moved away there from and when the final transfer process using the transfer roller 11 has ended, it is once again placed in contact with the belt 10 so as to scrape off the residual toner and dust and the like from the belt 10. It is also possible to do the opposite to this and keep the cleaning blade 61*a* normally away from the belt 10 and only place it in contact with the belt 10 when it is necessary.

Referring to FIG. 8 and FIG. 9A, as has already been described, the developing apparatuses 6 and 8, which haves been formed as units, the photoconduction units 140 and 240, and the belt unit 100 are each able to be freely installed in and removed from the apparatus body. The overall apparatus comprises: the developing apparatuses 6 and 8, the photoconduction units 140 and 240, the writing unit 18 and 28, as well as additional image forming structural elements housed in the lower case 105 shown in FIG. 8; and the belt unit 100, the engine circuit board 96 on which the sensing unit 101S is mounted facing downwards, the fixing apparatus 50, as well as additional image forming structural elements housed in the upper cage body 106.

Moreover, a portion of the pair of resistance rollers 44, the transfer roller 11, and other image forming structural elements are housed in the cover 108. When maintenance, tasks such as part replacement, and tasks related to processing jams and the like of the image forming elements such as the photoconductor drums 16 and 26, the belt 10 and the like and each of the image forming structural elements housed in the lower case 105 and the upper case 106 are performed, the upper case 106 and the cover 108 are opened wide from the lower case 105 and the respective unit or apparatus is removed or installed or the paper jam is removed. The image processing operation which uses the above described structure will now be described.

(1) When a print signal is generated, the photosensor 101S-1 of the sensing unit 101S detects the reflective marks 102 (see FIG. 10B) on the belt 10, and either at the same time or else after a time lag, the writing and image creation process operations are begun.

Next, an electrostatic latent image corresponding to the A color image is formed on the photoconductor drum 16 of the first image forming unit 14 by the static electrifier 17 and the writing unit 18, and this A color toner image is visualized by the A color developing apparatus 19. Next, the first transfer brush 41 and transfer roller 39 that have been positioned away from the belt 10 by the transfer movement unit are placed in contact with the belt 10, the belt 10 and the photoconductor drum 16 are placed in contact over a sufficient contact width for the transfer, and the A color toner image is transferred onto the belt 10. After the transfer, the first transfer brush 41 and the transfer roller 39 are again moved away from the belt 10.

(2) Before the A color toner image reaches the second image forming unit 24 as a result of the movement of the belt 10 in the direction shown by the arrow a, an electrostatic latent image corresponding to the B color image is formed on the photoconductor drum 26 by the static electrifier 27 and the writing unit 28 and the B color toner image is visualized by the B color developing apparatus 29. Next, the second transfer brush 42 and transfer roller 39' that have been positioned away from the belt 10 by the transfer movement unit are placed in contact with the belt 10, the belt 10 and the photoconductor drum 26 are placed in contact over a sufficient contact width for the transfer, and the B color toner image is transferred onto the belt 10 on top of the A color toner image. After the transfer, the second transfer brush 42 and the transfer roller 39' are again moved away from the belt 10.

(3) The belt 10 then turns substantially for one whole circle. Once more, the photosensor 101S-1 detects the previous reflective marks and the timing of the writing and image creation process are coincided. Before the superposed A color and B color images again reach the image forming unit 14, an electrostatic latent image corresponding to the C color image is formed on the photoconductor drum 16 by the static electrifier 17 and the writing unit 18 and the C color toner image is visualized by the CB color developing apparatus 20. Next, the first transfer brush 41 and transfer roller 39 that have been positioned away from the belt 10 by the transfer movement unit are placed in contact with the belt 10, the belt 10 and the photoconductor drum 16 are placed in contact over a sufficient contact width for the transfer, and the C color toner image is transferred onto the belt 10 on top of the A color and B color toner images. After the transfer, the first transfer brush 412 and the transfer roller 39 are again moved away from the belt 10.

(4) Before the A color, B color, and C color toner images reach the second image forming unit 24 as a result of the movement of the belt 10, an electrostatic latent image corresponding to the D color image is formed on the photoconductor drum 26 by the static electrifier 27 and the writing unit 28 and the D color toner image is visualized by the D color developing apparatus 30. Next, the second transfer brush 42 and transfer roller 39' that have been positioned away from the belt 10 by the transfer movement unit are placed in contact with the belt 10, the belt 10 and the photoconductor drum 26 are placed in contact over a sufficient contact width for the transfer, and the D color toner image is transferred onto the belt 10 on top of the A color, B color, and C color toner images. After the transfer, the second transfer brush 42 and the transfer roller 39' are again moved away from the belt 10. As a result of the above process, a full color image is formed on the belt 10. Namely, a full color image is formed on the belt 10 as a result of the belt 10 completing two revolutions.

Finally, when the D color toner image starts to be transferred by the second transfer brush 42 and the transfer roller 39', the paper P is guided by the guide 99 from the paper supply roller 91 that serves as a paper supply apparatus positioned below the image forming apparatus so that the paper P is fed in an upwards direction. The timing of the paper P is then adjusted by the pair of resistance rollers 44 and the paper P is then fed to the final transfer section 45 which is provided with the transfer roller 11.

The paper P is moved while being nipped between the transfer roller 11 and the belt 10 above the roller 13 and, at this time, a bias voltage is applied to the transfer roller 11. As a result, the full color image on the belt 20 is transferred onto the paper P.

After the transferred full color image has been transported away from the transfer roller 11 in the vicinity of the final transfer section 145, it is fixed by the fixing apparatus 50 provided above the belt 10. Meanwhile, as the belt 10 has completed the final transfer, the cleaning blade 61*a*, which had been positioned away from the belt 10 during the intermediate transfer process, is placed in contact with the belt 10 by the blade moving unit and the residual toner is cleaned off and removed. Furthermore, toner supply and processes such as electrostatification, transfer bias, and the like are controlled and a patch pattern is formed for each color on the belt 10 at a particular cycle and the toner density is detected by the density sensor 101S-2.

When a plurality of prints are being printed, when the A color and B color superposed images are transferred onto the belt 10 by the second image forming unit 24, a A color toner image is subsequently transferred onto the belt 10 by the first image forming unit 14 and the above steps (1) to (4) are repeated.

If the image forming apparatus is one in which the intermediate transfer medium is a belt shaped member, then by positioning the photoconductor drum on the non-tensioned side of the belt 10 and not providing the transfer movement unit for performing the intermediate transfer, it is possible to make the belt 10 come firmly into contact with the photoconductor drums 16 and 26 in the intermediate transfer section. In the present example, if the intermediate transfer medium is a belt shaped member, then the present invention can be applied if the photoconductor that carries the image is a belt shaped member or a drum shaped member.

In the above example, if the A color is set as magenta, the B color as yellow, the C color as cyan, and the D color as black, then in order to obtain a full color image, at the minimum only the A color, B color, and C color need be used and it is not absolutely necessary to use the D color.

Accordingly, even if the image forming apparatus has the structure of the above described image forming apparatus only with the D color image forming function removed therefrom, it is still possible to forma full color image. Because a three color superposed image is formed in the intermediate transfer section even in an image forming apparatus having such a structure, the fact that the load variation created by the cleaning blade 61*a* brings about a variation in the tension on the belt 10 is associated with a reduction in image quality.

In an image forming apparatus having the above structure, in an image forming apparatus structured such that the D color image forming function has been removed, by driving the roller 12*a* so that the cleaning blade 61*a* moves, it is possible to obtain a high quality image with no color misregistration because there are no changes in the tension on the belt caused by load variations when forming a color image in a combination of the three colors A, B, and C.

Naturally, if the D color image forming function is provided, then because a non-composite color black image is directly formed, a higher quality full color image can be obtained, however, in that case, because the number of superposed images is four, a greater degree of accuracy against color misregistration is required. In that case as well, because the roller for moving the cleaning blade 61*a* is set as the driver roller 12 thereby not creating any change in the tension on the belt 10 due to load variations, in an image forming apparatus having image forming functions in A color, B color, C color, and D color, it is possible to obtain a high quality image. Note that, because the D color developer is placed in the second image forming unit 24, which is close to the transfer roller 12, it is possible to speed up the processing time of the image formation for the first sheet of paper when the image being formed is a monochrome image.

As is seen in a conventional image forming apparatus, in a structure in which the image forming unit is placed at the upper side of the intermediate transfer belt, the transport path of the paper is formed so as to run alongside the belt surface so that the transport path is lengthened. In contrast to this, as shown in FIG. 9A, in the present example, when the belt 10 is extended, the extended surface on the non-tensioned side faces downwards and the image forming unit 14 and 24 are placed below the belt 10 so as to face this non-tensioned side extended surface.

Therefore, even if there are leakages or drips from the developing apparatuses 6 and 8, because the belt 10 is positioned above the developing apparatuses 6 and 8 in the direction of gravity, none of the drips or leaks can fall onto the belt 10. In a conventional structure in which the image forming unit are placed above the intermediate transfer belt, any toner that leaks from the developing apparatuses always drips downwards onto the intermediate belt thereby causing contamination of the paper. This does not happen in the structure of the present example.

Moreover, it has been normal hitherto for the transport path to be along the upper surface of the intermediate transfer belt, thereby lengthening the transport path, however, in the present example, because the image forming unit 14 and 24 are placed at the bottom side of the belt 10, it is possible to form the transport path of the paper P at one end of the surface of the belt 10 and in running a vertical direction, thereby enabling the transport path to be made as short as possible.

In the present example, toner images are sequentially formed on the belt 10 with the developing and transfer begun not from the second image forming unit out of the first image forming unit 14 and the second image forming unit 24 placed a fixed distance apart along the extended surface on the non-tensioned side of the belt 10, but from the first image forming unit that is positioned closest to the drive roller 12.

The closer the belt 10 on which the toner images are carried is to the drive roller 12 supporting the belt 10, the closer the belt 10 is to the supporting portion and the less the amount of sagging. Therefore, the accuracy with which the belt 10 can be positioned is increased. Accordingly, by beginning the developing and transfer from the first image forming unit 14, which is positioned closest to the drive roller 12, the transfer position is stabilized and an image of high image quality with no color misregistration can be obtained.

Because the image forming unit closest to the drive roller 12 is made the first image forming unit which then becomes the image formation standard and A color and C color image forming functions are performed by the first image forming unit, and an image is formed by the first image forming unit before it is formed by the second image forming unit, which has B color and D color image forming functions, it is possible to obtain an image of high image quality with no color misregistration when the image is a four color image formed from the three primary colors and black in which the forming of an image without color misregistration is particularly difficult.

Note that, in the above description, in an image forming apparatus in which the function of forming an image in the D color, namely, black has been removed from the second image forming unit, it is possible to obtain an image of high image quality with no color misregistration when the image is a three color image formed from the three primary colors.

In the image forming apparatus of the present example, the transfer roller 11, which is the final transfer roller, is provided facing the roller 13 at the opposite side from the drive roller 12; and a fixing apparatus 50, serving as a fixing unit for fixing the toner images superposed onto the paper P that has been transported via the transfer roller 11, and having a storage section for storing the paper P provided below the image forming apparatus and a transport path running in a substantially vertical direction along the guide 99 from the storage section to the transfer roller 11, is provided in the vicinity of the transfer roller 11 which is an extension of the transport path.

Namely, because the transport path of the paper P, which is provided with cleaning unit such as the cleaning blade 61*a*, is formed at the opposite side to the drive roller 12 where there is a possibility of splashes of toner, there is no possibility of the paper P on which an image has been formed being contaminated.

(3) Transfer Movement Unit and Blade Moving Unit:

A description will now be given of the transfer movement unit for moving the transfer roller 39 and the first transfer brush 41 serving as intermediate transfer unit towards or away from the belt 10 in the area opposite the photoconductor drum 16, and the blade moving unit for moving the cleaning blade 61*a* towards or away from the belt 10 in the area opposite the drive roller 12.

Figure 11:
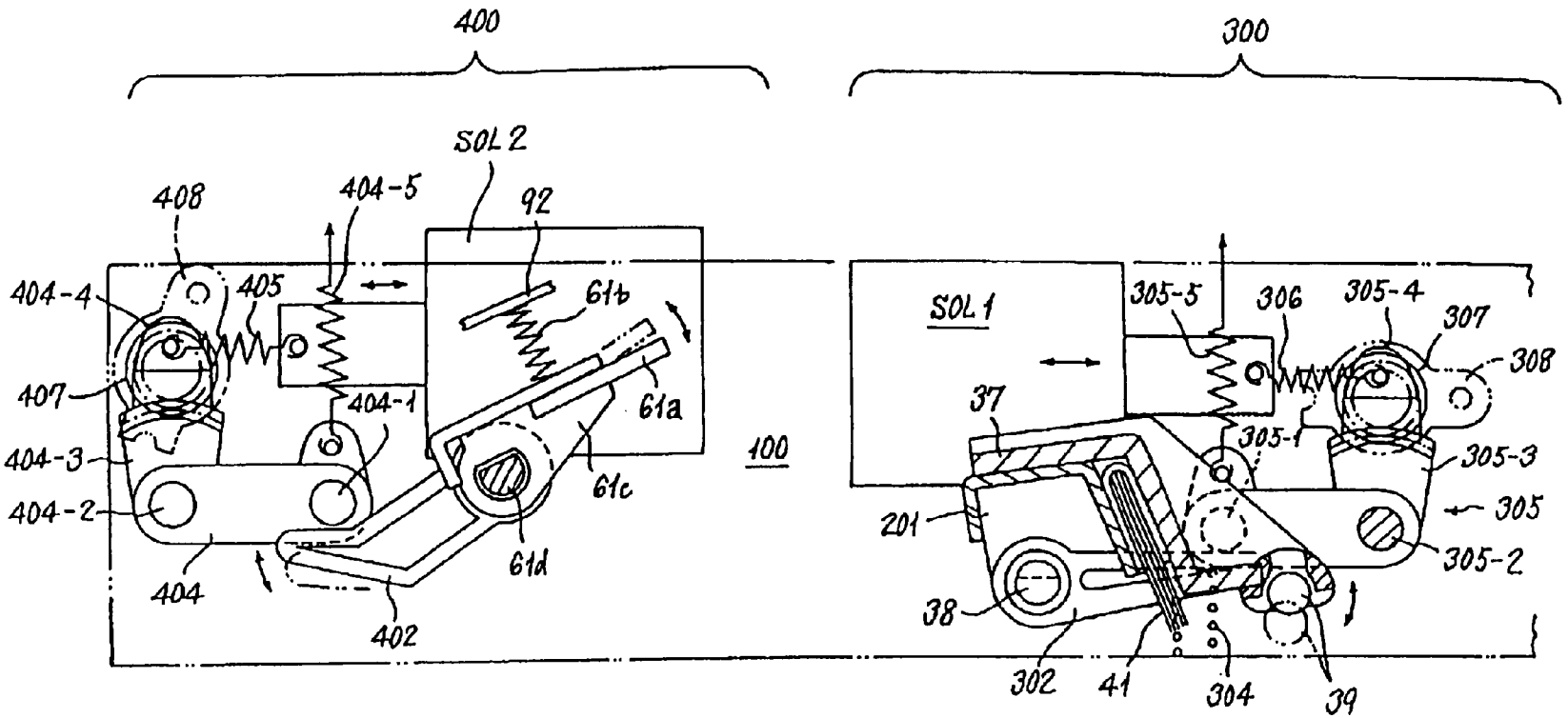
FIG. 11 is a front elevational view of a blade movement unit and a transfer movement unit.

The right side of FIG. 11 shows the transfer movement unit 300 as seen from the same direction as in FIG. 1. The left side of FIG. 11 shows the blade moving unit 400 as seen from the same direction as in FIG. 1. The right side of FIG. 12 shows the transfer movement unit 300 of FIG. 11 from the top, while the left side of FIG. 12 shows the blade moving unit 400 of FIG. 11 from the top. In these figures, only the main portions are extracted in order to simplify the description and non-essential portions have been omitted. Note that, because the transfer movement unit for moving the transfer roller 39' and the second transfer brush 42 serving as intermediate transfer unit towards or away from the belt 10 in the area opposite the photoconductor drum 26 use the same mechanism as will be described for the transfer movement unit 300, a description thereof is omitted.

1. Transfer Movement Unit

Figure 12:
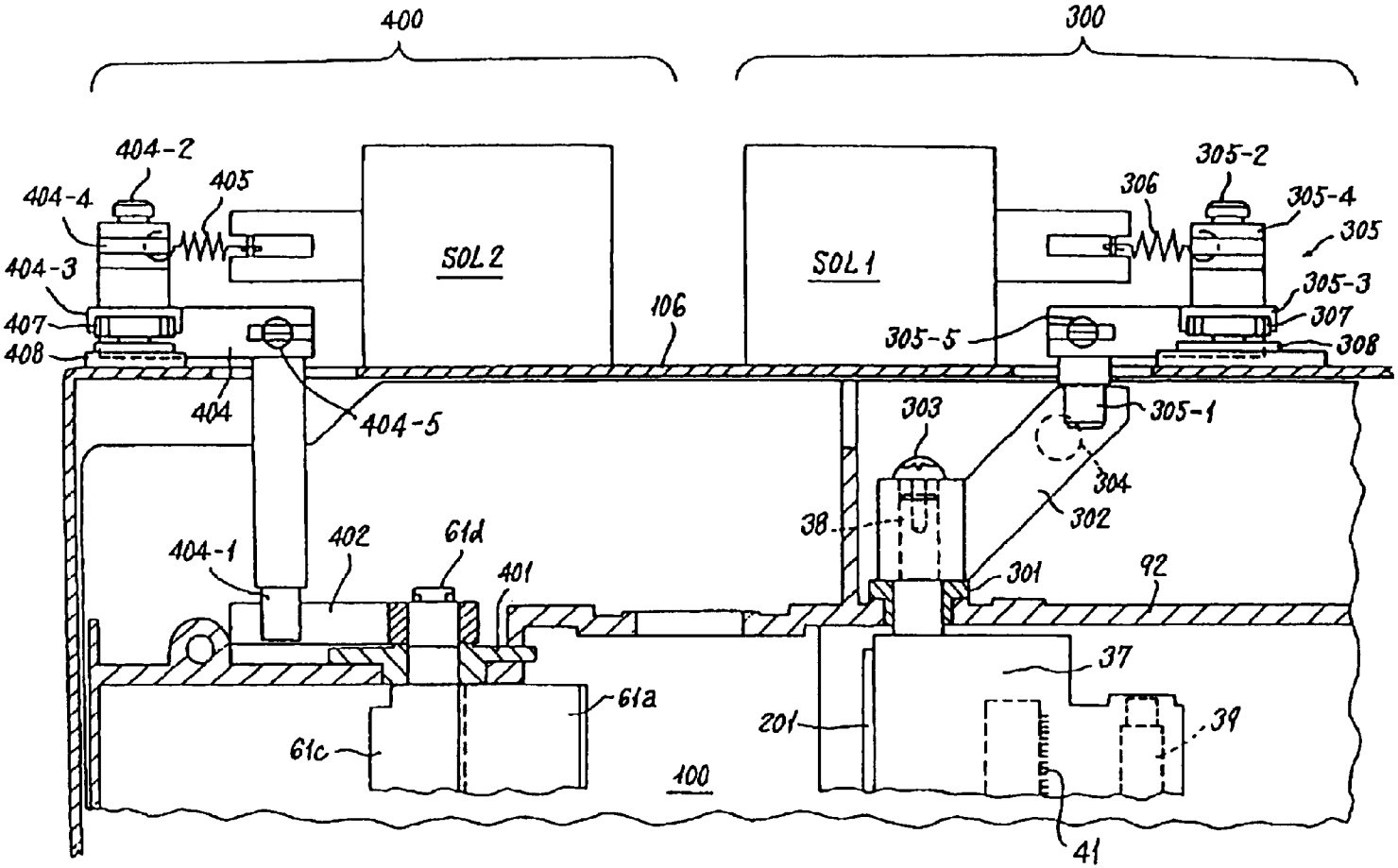
FIG. 12 is a plan view of a blade movement unit and a transfer movement unit.

In FIG. 11 and FIG. 12, the first transfer brush 41 is fixed to the holder 37 and the transfer roller 39 is supported at the holder 37. The holder 37 is fixed to the bracket 201. The holder 37 and the bracket 201 are elongated in the transverse direction of the belt 10 and shafts extend from both end portions thereof. In the drawing one of these shafts is allocated the legend 38.

The shaft 38 is axially supported by the bearing 301 provided in the frame 92 and the distal end portion thereof penetrates the bearing 301. This penetrating portion is formed in a half moon shape with the shaft portion cut in a D cut and after this D cut portion has been inserted into a hole formed in a D shape formed in the proximal end portion of the lever 302, it is locked in place from the outside with a screw 303. The other end of the bracket 201 is also supported at the frame 92 by the same mechanism. As a result, a relationship is formed whereby, if the lever 302 is oscillated around the fulcrum of the shaft 38, the integrated holder 37 and the bracket 201 also oscillate together via the shaft 38.

As described above, the proximal end portion of the lever 302 is formed integrally with the shaft 38, however, an extendible spring 304 is positioned in contact with the bottom surface of the free end side thereof. The spring 304 imparts moment to the free end side of the lever 302 in the direction of lifting it upwards. Namely, in FIG. 11, the lever 302 receives moment from the spring 304 in an anticlockwise direction around the shaft 38. As a result of this moment, the first transfer brush 41 and the transfer roller 39 receive a force in the direction away from the belt 10 together with the holder 37 around the shaft 38.

A shaft 305-1 for controlling the rotation of the lever 302 is in constant contact with the portion of the upper surface of the lever 302 that corresponds to the exact opposite side of the portion of the lever 302 pushed from below by the spring 304. The shaft 305-1 prevents the lever 302 from being rotated by the moment imparted from the spring 304 and is positioned so as to control the rotation position. The shaft 305-1 penetrates from the outer side to the inner side through an aperture formed in a side plate portion of the upper case 106 and is in contact with the free end side of the lever 302.

Figure 13:
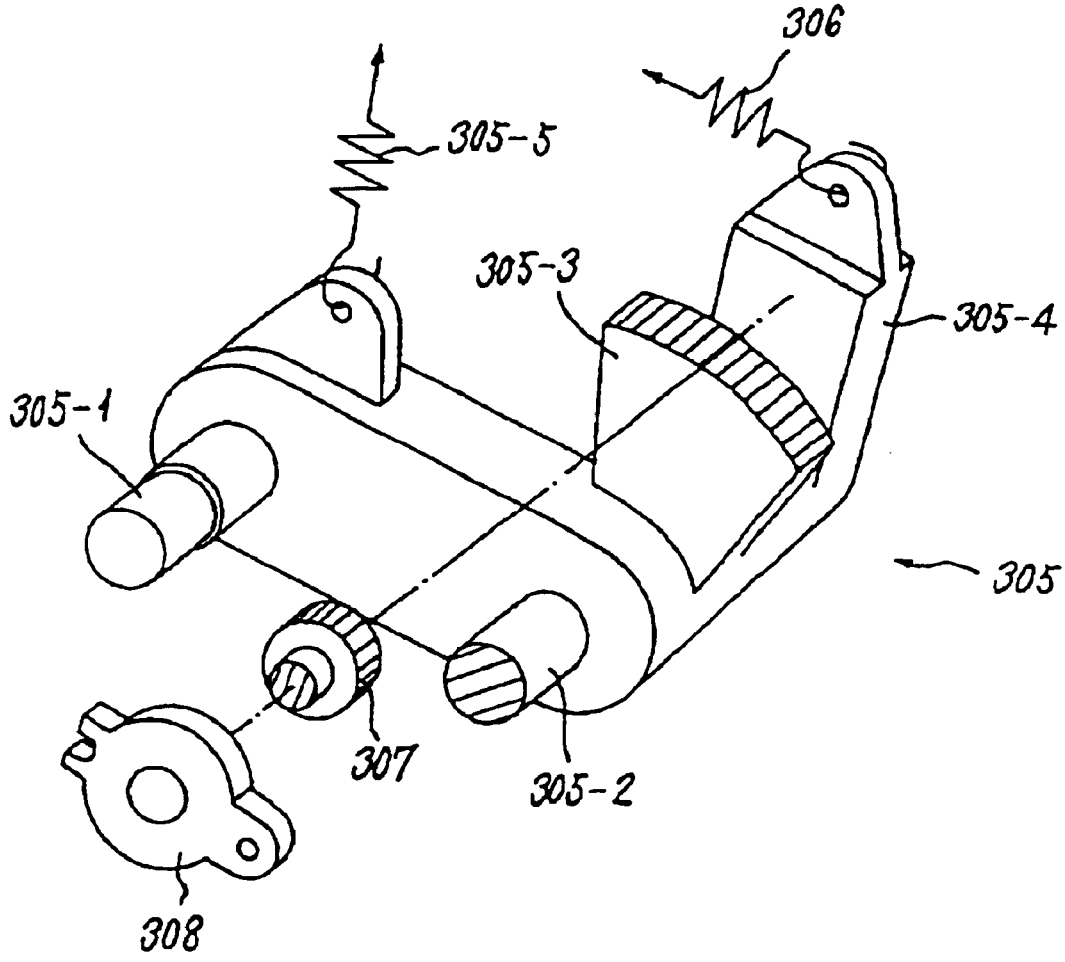
FIG. 13 is a perspective view of the link that is a structural member of the transfer movement unit.

The shaft 305-1 forms a portion of the link 305. The overall outline of the link 305 is shown in FIG. 13. One end of a shaft 305-1 protruding parallel with the shaft 305-1 is supported by the side plate portion of the upper case 106 at a position away from the shaft 305-1. Accordingly, the link 305 is able to oscillate around the fulcrum of the shaft 305-2.

A description will now be given with reference to FIG. 11, FIG. 12, and FIG. 13. In the link 305, a segment gear 305-3 and an arm 305-4 are provided coaxially with the shaft 305-2 and at a position shifted in the axial direction.

A solenoid SOL1 is provided in the upper case 106. A taut spring 306 is stretched between the plunger of the solenoid SOL1 and the distal end portion of the arm 305-4.

A taut spring 305-5 is also attached to the top of the link 305 in the vicinity of the shaft 305-1 and imparts moment to the link 305 in the clockwise direction around the shaft 305-2 (see FIG. 11).

In FIG. 11, the solenoid SOL1 is shown in an off (i.e. non-magnetized) state. In this off state, the link 305 is rotated in a clockwise direction around the shaft 305-2 by the elasticity of the extension of the spring 304 and the pulling force of the spring 305-5. Because the shaft 305-1 also rotates, the holder 37 is rotated around the fulcrum of the shaft 38 by the force of the spring 304 in a direction away from the belt 10. The first transfer brush 41 and the transfer roller 39 are thus both moved away from the belt 10.

If the solenoid SOL1 is turned on (i.e. is magnetized), the plunger is pulled in resulting in the link 305 rotating in a counterclockwise direction around the fulcrum of the shaft 305-2 against the elasticity of the spring 305-5 and the spring 304. Because of the attendant pushing down by the shaft 305-1 of the lever 302, the first transfer brush 41 and the transfer roller 39 are placed in contact with the belt 10 as a result of this operation.

In this operation, it is not generally possible to operate the solenoid SOL1 slowly in an analog type manner. Therefore, because the movement by the first transfer brush 41 and the transfer roller 39 due to the turning on or off of the solenoid SOL 1 is abrupt, the movement is changed into impact force and vibration which is transmitted to the belt 10 and photoconductor drum 16 thereby reducing transfer accuracy and writing accuracy. The same is also the case for the photoconductor drum 26.

Therefore, in the present example, a cushioning unit for cushioning the abrupt movement when the solenoid SOL 1 is turned on or off is provided. This cushioning unit is a rotation type cushioning unit and, in the present example, employs an oil damper.

The pinion gear 307 meshes with the segment gear 305-3. The shaft of the pinion gear 307 is integrally connected with an impeller (not shown) inside the rotation type cushioning unit 308. The impeller is able to rotate in oil. The rotation type cushioning unit 308 is fixed to a side plate of the upper case 106.

If, in the above structure, a sudden rotation force is applied to the pinion gear 307, because the impeller rotates in oil, the sudden rotation of the pinion gear 307 is suppressed by the force of the viscosity. Namely, because it acts as a resistant force on the segment gear 305-3 to suppress the rotation of the link 305, the end result is that it is possible to cushion the impact force and vibration generated when the first transfer brush 41 and the transfer roller 39 move relative to the belt 10.

In the present example, the segment gear 305-3 and the pinion gear 307 are used, however, the present invention is not limited to this and any structure and configuration may be used provided it is connected to the link 305 and can manifest a viscous force in the rotation type cushioning unit 308.

Figure 14A:
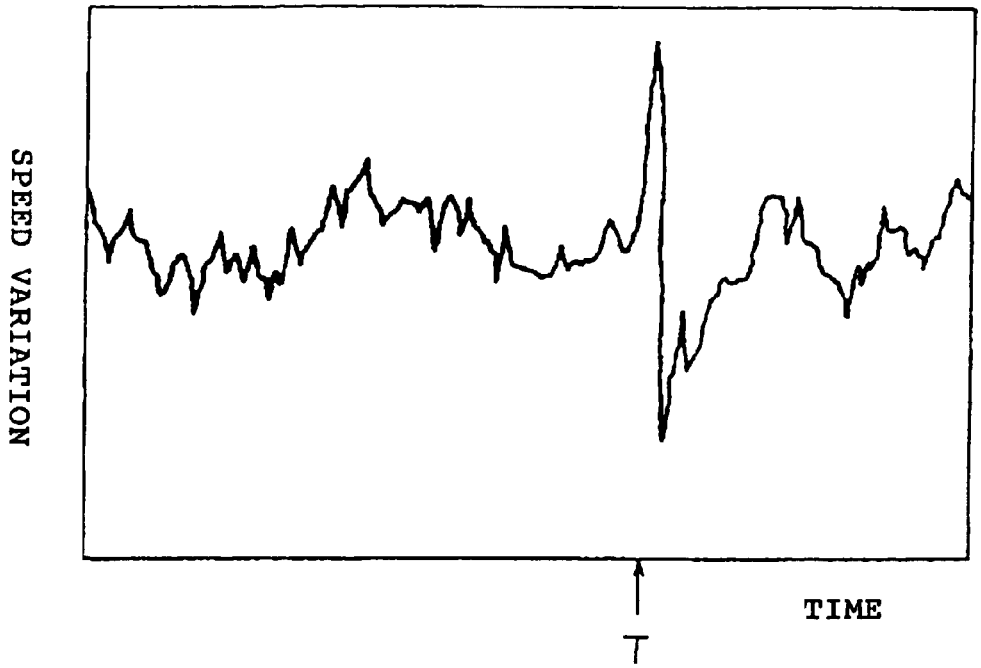
Figure 14B:
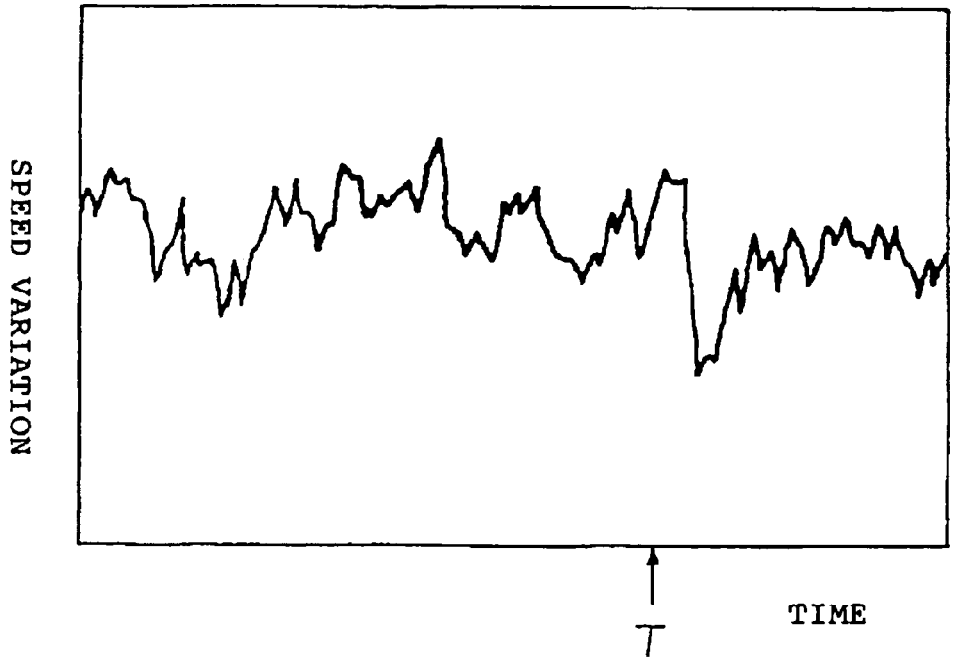
FIG. 14B is a view showing variations in the belt speed when cushioning unit is provided.

The data obtained when speed variations in the belt were measured in order to confirm the effect of the cushioning by the cushioning unit is shown in FIG. 14A and FIG. 14B. FIG. 14A shows the speed variation in the belt 10 when the cushioning unit of the present example is not provided, while FIG. 14B shows the speed variation in the belt 10 when the cushioning unit of the present example is provided.

The point T in the graphs shows the instant when the first transfer brush 41 and the transfer roller 39 are placed in contact with the belt 10. From the comparison of FIG. 14A and 14B, it is clear that, speed variations can be reduced by providing the cushioning unit. By employing the same structure for the movement unit of the second brush roller 42 and the transfer roller 39', the same effect is obtained.

2. Blade Moving Unit

The moving unit for the intermediate transfer unit described above. The reasoning and structure and the like applied thereto are substantially the same as are applied to the means for moving the cleaning blade 61*a* relative to the belt. These are described below.

The bracket 61*c* to which the cleaning blade 61*a* is mounted is formed integrally with the shaft 61*d*. The shaft 61*d* is axially supported by a bearing 401 provided in a side plate of the frame 92 of the belt unit 100. The shaft 61*d* penetrates the bearing 401 and the distal end thereof protrudes towards the outer side past the side plate portion of the frame 92.

This protruding portion is cut in a D shape and this D cut portion engages with a D shaped hole formed in the proximal end portion of the lever 402 and is held in place by a not shown E ring. As a result, the shaft 61*d* and the proximal end portion of the lever 402 are substantially made into a single member and the bracket 61*c* is able to be swung around the shaft 61*d* by the lever 402. The cleaning blade 61*a* is made to move towards or away from the belt 10 at a position facing the drive roller 12 in accordance with this swinging movement.

As shown in FIG. 11, an extendible spring 61*b* is inserted between the bracket 61*c* and the frame 92. The spring 61*b* provides urging force in a direction such that the cleaning blade 61*a* is moved towards the belt 10 at a position facing the drive roller 12.

A shaft 404-1 is provided so as to always be in contact from above with the free end portion of the lever 402 so as to inhibit the movement (rotation) of the lever 402. The shaft 404-1 penetrates from the outer side to the inner side through a hole formed with a clearance in the side plate portion of the upper case 106 and is formed integrally with the link 404.

Figure 15:
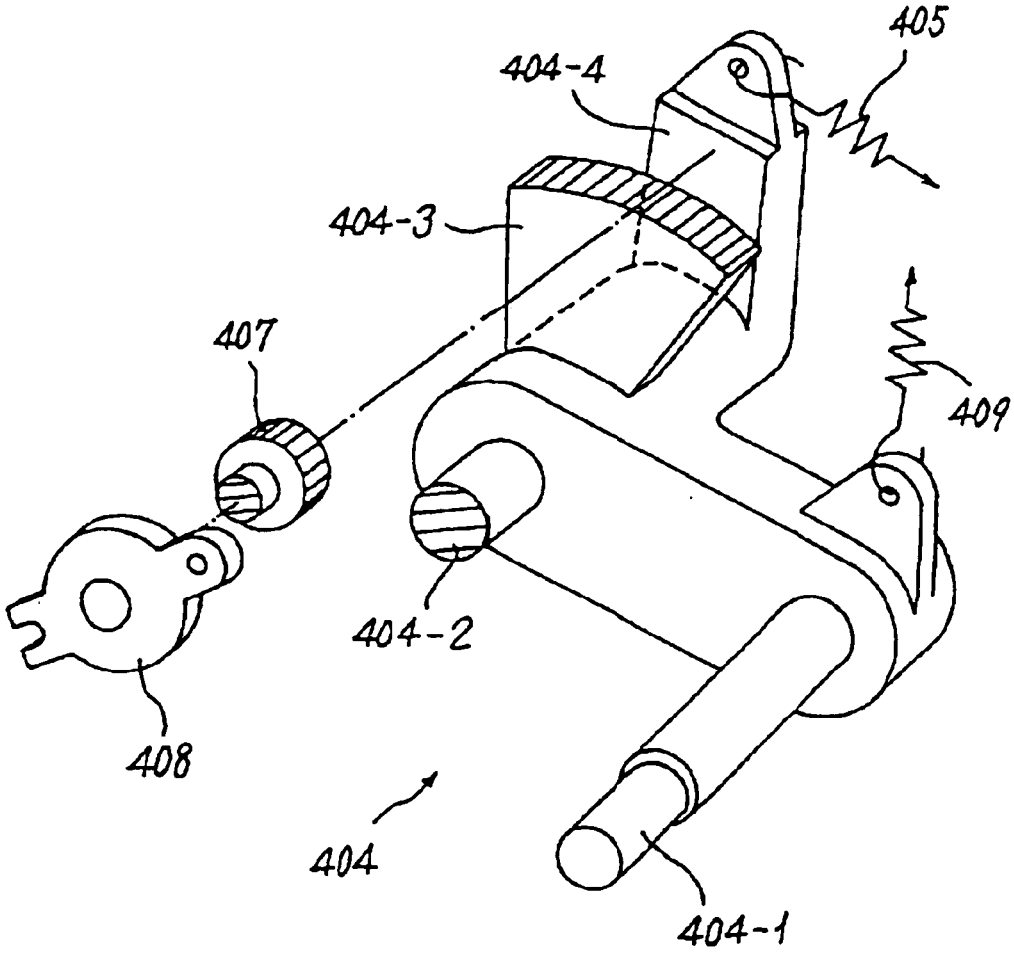
FIG. 15 is a perspective view of the link that is a structural member of the blade movement unit.

The remainder of the structure is the same as was described for the transfer movement unit, however, a brief description thereof will now be given. The link 404 shown in FIG. 15 is provided with a shaft 404-1 and a shaft 404-2 at a position away from the shaft 404-1. The overall structure of the link 404 is as shown in FIG. 15 and the shaft 404-2 protruding parallel with the shaft 404-1 from the position away from the shaft 404-1 is supported in a cantilever manner by the side wall portion of the upper case 106. Accordingly, the link 404 is able to oscillate around the fulcrum of the shaft 404-2.

A description will now be given with reference to FIG. 11, FIG. 12, and FIG. 15. In the link 404, a segment gear 404-3 and an arm 404-4 are provided coaxially with the shaft 404-2 at a position shifted in the axial direction.

A solenoid SOL2 is provided in the upper case 106. A taut spring 405 is stretched between the plunger of the solenoid SOL2 and the distal end portion of the arm 404-4. A taut spring 404-5 is also attached to the top of the link 404 in the vicinity of the shaft 404-1 and imparts moment to the link 404 in the counter clockwise direction around the shaft 404-2 (see FIG. 11).

In FIG. 11, the solenoid SOL2 is shown in an off (i.e. non-magnetized) state. In this off state, the link 404 is rotated in a counter clockwise direction around the shaft 404-2 by the pulling force of the spring 404-5. Because the shaft 404-1 also rotates, the 61*c* is rotated around the fulcrum of the shaft 61*d* by the force of the spring 61*b* in a direction towards the belt 10. The cleaning blade 61*a* is thus both moved into contact with the belt 10.

If the solenoid SOL2 is turned on (i.e. is magnetized), the plunger is pulled in resulting in the link 404 rotating in a clockwise direction around the fulcrum of the shaft 404-2 against the elasticity of the spring 61*b* and the spring 409. Because of the attendant pushing down by the shaft 404-1 of the lever 402, the cleaning blade 61*a* is moved away from the belt 10 as a result of this operation.

In this operation, in the same way as for the transfer movement unit 300, it is not possible to operate the solenoid SOL2 slowly in an analog type manner. Therefore, because the movement by the cleaning unit 61*a* due to the turning on or off of the solenoid SOL2 is abrupt, the movement is changed into impact force and vibration which is transmitted to the belt 10 and photoconductor drum 16 thereby reducing transfer accuracy and writing accuracy.

Therefore, in the present example, a cushioning unit for cushioning the abrupt movement when the solenoid SOL2 is turned on or off is provided. This cushioning unit is a rotation type cushioning unit and, in the present example, employs an oil damper.

The pinion gear 407 meshes with the segment gear 404-3. The shaft of the pinion gear 407 is integrally connected with an impeller (not shown) inside the rotation type cushioning unit 408. The impeller is able to rotate in oil. The rotation type cushioning unit 408 is fixed to a side plate of the upper case 106.

Because the material from which the cleaning blade 61*a* is formed is generally rubber, the movement of the cleaning blade 61*a* is different from the movement of the transfer portion and the impact during movement is extremely large and the resulting effect on the belt 10 is also large. In particular, when a structure is employed in which the cleaning blade 61*a* is brought into contact with the belt 10 using a counter format, as in the present example, there is a concern that not only will the sped vary, but the belt 10 and cleaning blade 61*a* will also be damaged. Therefore, it is necessary to give the first priority to providing the cushioning unit for the cleaning unit and this has an enormous effect.

A similar structure to that of the present example can also be applied to the moving unit for a lubricating agent coating apparatus for coating a lubricating agent (such as zinc stearate or the like) on the belt 10 in order to reduce the friction resistance of the cleaning blade 61*a* to the belt 10.

In the transfer movement unit and blade moving unit, the reason why the link 305 and the lever 302 as well as the link 404 and the lever 402 are formed as separate structures and then engaged together is so that the belt unity 100 can be inserted in and removed from the cage body 98 provided in the upper case 106.

Namely, because it is necessary to be able to replace the belt unit 100 in the upper case 106, the shaft 305-1 and the shaft 404-1 that are provided inside the upper case 106 and protrude towards the inner side facing the belt unit 100 must not interfere with the structural parts of the belt unit 100 when the belt unit 100 is being inserted or removed. In particular, the relationships of the lever 302 to the shaft 305-1 and of the lever 402 to the shaft 404-1, namely, the insertion angle and position of the lever 302 and the lever 402 when the belt unit 100 is inserted and loaded need to be given special attention.

Moreover, in the present example, the description has centered on the moving unit relative to the belt 10, however, it is also possible to apply the moving unit having the same structure as that described for FIG. 11, FIG. 12, and the like to an apparatus having a moving unit for moving a developer relative to a photoconductor drum, or to an apparatus having a moving unit for moving a cleaning blade or static electrifier relative to a photoconductor drum, or to an apparatus having a moving unit for moving a lubricating agent coating apparatus relative to a photoconductor drum.

It is also possible to link the cushioning unit to a part of the moving unit, as in the present example. It is also possible for the cushioning unit to be placed at a different position to the moving unit, namely, directly connected to the moving cleaning blade or transfer unit or the like.

Because the image forming apparatus of the present example allows a high speed print output to be obtained in synchronization with the rotation of the belt 10, it is possible to use a photoconductor drum as an image carrier and a laser light source or a combination of an LED and focusing photo transmitting body as a writing unit, or to use an endless belt as the image carrier. Nor is the present invention limited to a photosensitive body and a medium that allows the formation thereon of a latent image using the operation of a unit other than light, or a writing unit that allows electric or magnetic changes to be made in such an image carrier by the operation of a unit other than light can also be used.

Note that, in the above example, a PTFA (polytetrafluoroethylene) belt having a thickness of approximately 0.15 to 0.6 mm is used as the belt 10.

B. Tandem Type Image Forming Apparatus

Figure 16:
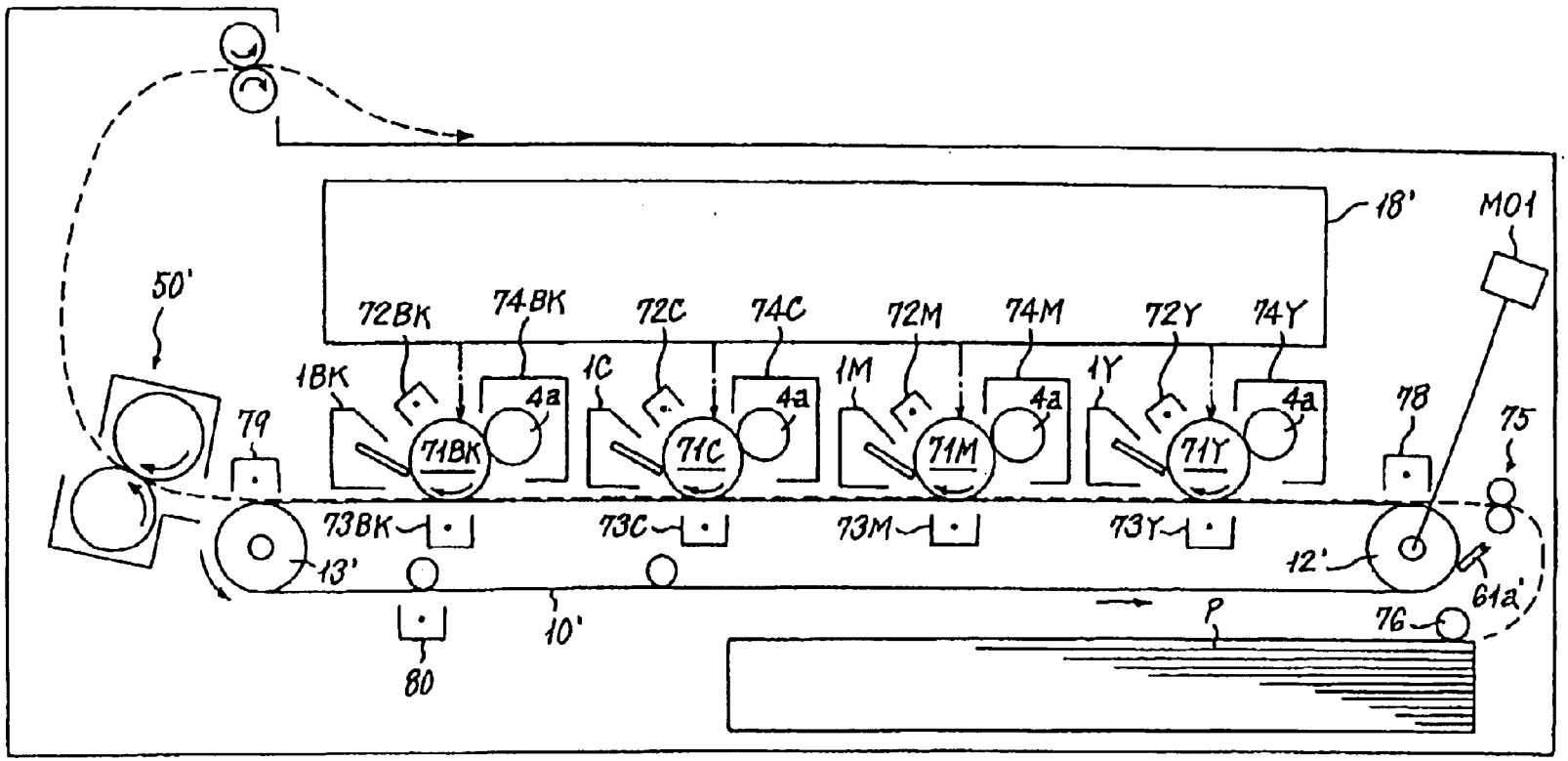
FIG. 16 is a view showing the structure of a tandem type of image forming apparatus according to the present invention.
Figure 17B:
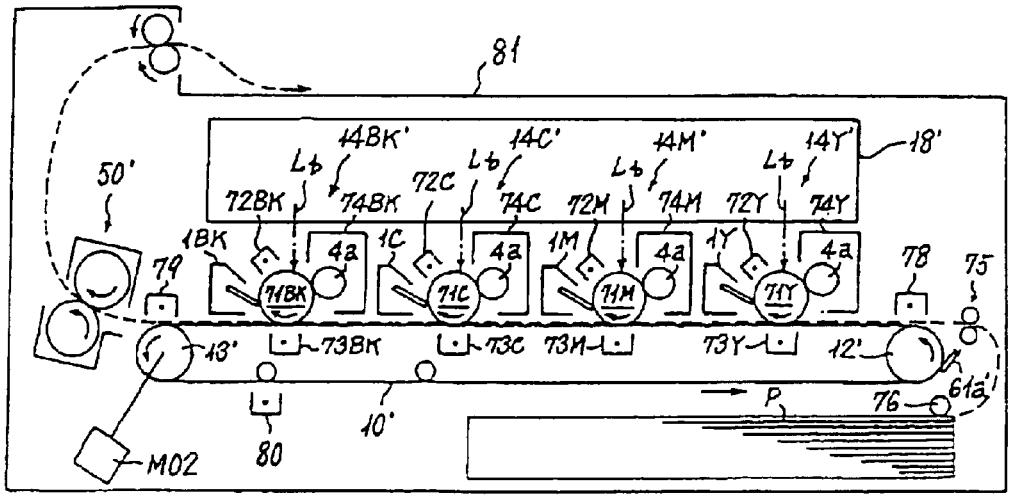
FIG. 17B (PRIOR ART)
FIG. 17B is a schematic structural view of a conventional tandem type of image forming apparatus.

FIG. 16 shows a tandem type image forming apparatus according to the present invention. In FIG. 16, the members that are the same as those in FIG. 17B are provided with the same legends and a description thereof is omitted. In FIG. 16, a belt 10' having a function of carrying the paper P is entrained between two rollers 12' and 13' provided at a distance from and facing each other. The belt 10' is formed so as to be rotated by these two rollers 12' and 13'.

Further, around the belt 10 are provided: an image forming unit equipped with developing units 74Y, 74M, 74C, and 74BK for developing as a toner image an electrostatic latent image previously formed on photoconductor drums 71Y, 71M, 71C, and 71BK; and a processing unit used for image formation that includes transferring units 73Y, 73M, 73C, and 73BK for transferring the toner image carried on the photoconductor drums 71Y, 71M, 71C, and 71BK in the image forming unit onto the paper P that has been transported together with the belt 10'.

A cleaning process in which the cleaning blade 61*a*, which is one of the processing unit, is made to function during the rotation of the belt 10' so as to remove any contamination prior top the formation of the next image is performed. The blade is moved so as to avoid the joins in the belt 10' and a load variation is applied to the rotation of the roller 12'.

In an image forming apparatus having this type of structure as well, by linking a drive source MO2 to the roller 12' to which the variation in the rotation load is imparted so that the roller 12' is made the drive roller for the belt 10', even if there is a load variation imparted to the roller 12' via the belt 10' caused by the movement of the cleaning blade 61*a*, it is possible to prevent the effects of this load variation being reflected as unevenness in the rotation of the belt 10'. Accordingly, it is possible to avoid reductions in image quality in the transferred image caused by uneven rotation.

The present invention is effective even if there is no moving unit in the intermediate transfer section provided that the intermediate transfer body is a belt shaped member. Namely, even if the image forming apparatus is one in which no moving unit is provided such as in JP-A No. 7-144414 described as the conventional technology (see FIG. 2 of the cited application), by positioning a photoconductor drum at the non-tensioned side of the belt serving as an intermediate transfer body and positioning a photosensor, for example, as a sensing unit at the tensioned side, it is possible to reduce the fixing force required to fix the position of the transfer unit, and also to simplify and improve the accuracy of the detection by the sensing unit. Moreover, as long as the medium serving as the intermediate transfer body is belt shaped, the present invention is not limited to a photoconductor drum, but can also be applied to a belt shaped photoconductor or a drum shaped photoconductor.

According to the belt device of one aspect of the present invention, because the roller to which a load variation is imparted is set as the drive roller, even when it receives a load variation, there is hardly any variation in the rotation of the drive roller. As a result, without varying the tension of the belt, pitch unevenness and color misregistration caused by shifting of the image being written on the belt can be abolished.

Furthermore, when there are a plurality of processing units for imparting a load variation, by setting as the drive roller that roller to which the rotational load variation is being imparted by the processing unit imparting the largest load variation out of the plurality of processing units, it is possible to reduce pitch unevenness and color misregistration caused by shifting of the transfer image due to the load variation.

Furthermore, power transmission can be reliably performed and a structure is provide in which one of the meshing members or one of the members in frictional contact can be easily disengaged from the other of the meshing members or the other of the members in frictional contact, thereby simplifying maintenance.

Furthermore, because the roller to which the load variation is imparted by the cleaning blade (which is considered to be the largest load variation) is set as the drive roller, even if the timing of the cleaning and the timing of the non-cleaning overlap with the timing of the image formation on the belt, it is still difficult for pitch unevenness and color misregistration to be generated in the image being transferred onto the belt.

Furthermore, the impact from the cleaning blade on the roller is cushioned by a cushioning unit and the load variation is reduced.

Furthermore, there is no need for a separate drive source formed by the processing drive system 95 and it is possible to avoid complicating the structure.

According to the image formation device of another aspect of the present invention, because the belt apparatus used for forming an image is formed as a unit that can be inserted in and removed from the main body portion, it is possible when necessary to remove the belt unit that includes the belt from the main body portion simplifying maintenance of the belt necessary after the lapse of a certain length of time.

Furthermore, it is possible to connect and separate a power transmission path between the main body portion side drive system and the unit side drive system through the insertion—separation of the belt unit in the main body portion. Thus, a safe insertion-separation operation is ensured without any special power transmission path connection/separation unit being required.

Furthermore, it is possible to obtain a state of connection of the power unit through the operation of pushing the belt unit into the cage body, and it is possible to obtain a state of separation in which the state of connection is terminated by the operation of removing the belt unit from the cage body without there being any need for a special connecting separation unit.

Furthermore, because a structure is employed in which a combination of the gears in both the main body side drive source and the unit side drive source are used, it is possible to easily obtain a reliable state of transmission of power and a state of non-transmission of power through the operation of connecting or separating these gears.

According to the image formation device of still another aspect of the present invention, even if a load variation is imparted to the drive roller, because the effect of this does not reach the belt, there is naturally no pitch unevenness or color misregistration in the visualized image that has undergone intermediate transfer. Moreover, because the image forming unit is provided on the extension surface of the belt that becomes the non-tensioned side, it is possible using only a small force to place the belt and the image carrier in the intermediate transfer step in contact with each other over a sufficient contact width for intermediate transfer to be possible, thereby making possible an improvement in the transfer efficiency as well as stable transfer and contributing to an improvement in image quality.

Furthermore, when forming a color image in a combination of the three colors A, B, and C, because there is no change in the tension on the belt due to variations in the load, a high quality image with no color misregistration can be obtained.

Furthermore, when forming a color image in a combination of four colors, which requires an even higher level of accuracy to avoid color misregistration, because there is no change in the tension on the belt due to variations in the load, a high quality image with no color misregistration can be obtained.

Furthermore, it is possible to make the extended surface of the belt on the tensioned side and the extended surface of the belt on the non-tensioned side substantially parallel, and because the belt unit is formed in a compact box shaped configuration with no large protrusions or hollows, the task of replacing the belt is simplified thereby contributing to making the apparatus even smaller in size.

Furthermore, because the image forming unit are provided underneath the belt, there is no contamination of the belt by developing agent and the problem of back staining of the sheet shaped medium is solved. Moreover, the transport path of the sheet shaped medium can be made as short as possible.

Furthermore, by starting the developing and transferring from the image forming unit whose position is the closest to the drive roller, the transfer position is stabilized and it is possible to obtain a high quality image with no color misregistration.

Furthermore, it is possible to obtain a high quality three color image having no color misregistration.

Furthermore, it is possible to obtain a high quality image having no color misregistration in a four color image which requires an even higher level of accuracy to avoid color misregistration.

Furthermore, because the movement of the transfer unit relative to the belt takes place on the non-tensioned side of the belt, the force required during the movement operation only needs to be a small force and it is possible to bring the belt into contact over a sufficient contact width using this small force. If the intermediate transfer medium is left in contact with the belt, the residual developing agent on the belt becomes adhered to the intermediate transfer medium and there is a danger that the medium will be offset, however, this can be avoided by moving the intermediate transfer medium away from the belt.

Furthermore, a current circuit is created between the members and the image carrier via the belt, and a sufficient contact width is obtained providing an increase in transfer efficiency.

Furthermore, variations in the speed of the belt when the intermediate transfer unit moves relative to the belt are tempered by the cushioning unit and variations in the speed of the belt are suppressed enabling the image to be prevented from shifting during image formation.

Furthermore, because the transport path of the sheet shaped medium is formed on the opposite side of the drive roller that is provided with the cleaning unit that is prone to causing splashes of developing agent, there is no contamination of the sheet shaped medium on which an image has been formed by the developing agent.

According to the image formation device of still another aspect of the present invention, in a tandem type of image forming apparatus, because the roller to which a load variation is imparted is set as the drive roller, it is difficult for a rotation variation to be generated in the drive roller even if there is a variation in the load on the drive roller. As a result, there is no variation in the tension on the belt and the problems of pitch unevenness and color misregistration caused by the image being written shifting on the belt are solved.

According to the image formation device of still another aspect of the present invention, because it is possible to improve the efficiency of the transfer of a toner image onto the belt by a simple structure and to improve and stabilize the accuracy of the various types of sensing of the belt, a high grade color image apparatus having a small size and low cost can be provided.

According to the image formation device of still another aspect of the present invention, it is possible to further improve the image quality by applying the present invention to the technology disclosed in JP-A No. 10-177286, which is the conventional technology. In the twenty-sixth aspect of the present invention, it is possible to simplify the task of assembly.

Furthermore, it is possible to achieve a cost reduction and a simplification of the wiring pattern in the sensing unit.

Furthermore, because the sensing unit (i.e. the photosensor 101S-1) for generating an image formation reference signal is positioned near the drive roller, by setting the image forming unit closest in distance and time to the sensor as the reference for image formation, it is possible to increase the accuracy of the image position and the accuracy of the color matching.

According to the image formation device of still another aspect of the present invention, because efficient, highly stable transfer is made possible and it is possible to increase the accuracy of detecting and controlling the state and functioning of the image forming apparatus, a high grade color image can be provided.

The present document incorporates by reference the entire contents of Japanese priority documents, 2000-95330 filed in Japan on Mar. 30, 2000 and 2000-313331 filed in Japan on Oct. 13, 2000.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A belt apparatus used for image formation structured such that a belt is extended between at least two rollers provided opposite to and at a distance from each other and the belt is rotated by the rotation of the rollers, and structured such that processing means used for image formation are arranged around the belt and the processing means are made to function while the belt is being rotated, the belt apparatus including an intermediate transfer means comprising a transfer brush and a transfer roller, and at least one of the processing means acts on any one of the two rollers while an image is being formed on the belt thereby imparting a rotational load variation to that roller, wherein the roller to which a rotational load variation is directly imparted by the processing means is set as a roller that drives the belt, wherein a structure is employed in which the drive roller is linked to a drive source via a roller drive system equipped with a power transmission system that uses frictional contact, and rotational force from the drive source is transmitted to the drive roller via the roller drive system, wherein, when there are a plurality of processing means imparting a load variation, the roller to which a rotational load variation is being imparted by the processing means imparting the largest load variation is set as the roller that drives the belt, and wherein the transfer brush and the transfer roller have an electrical potential difference and a bias power supply is provided to apply a bias voltage to the transfer brush and the transfer roller to form a bias circuit.

2. The belt apparatus used for image formation according to claim 1, wherein cleaning means equipped with a cleaning blade structured so as to move towards or away from the belt at the winding portion where the belt is wound around the roller is set as the processing means imparting the largest load variation.

3. The belt apparatus used for image formation according to claim 2, wherein there is further provided blade moving means for moving the cleaning blade towards or away from the roller, and there is further provided cushioning means for suppressing an impact when the cleaning blade comes into contact with the belt.

4. The belt apparatus used for image formation according to claim 2, wherein a structure is employed in which the cleaning means is supplemented by processing means for performing processing to contain waste developing agent scraped from the belt by the cleaning blade in a waste developing agent container, and in which a processing drive system for driving the processing means is able to drive the processing means using power from the roller drive system.

5. An image forming apparatus for forming an image by executing at least static electrification, exposure, developing, and transferring image formation processes, said image forming apparatus comprising:

a main body portion;

a belt apparatus used for image formation structured such that a belt is extended between at least two rollers provided opposite to and at a distance from each other and the belt is rotated by the rotation of the rollers, and structured such that processing means used for image formation are arranged around the belt and the processing means are made to function while the belt is being rotated, the belt apparatus including an intermediate transfer means comprising a transfer brush and a transfer roller, and at least one of the processing means acts on any one of the two rollers while an image is being formed on the belt thereby imparting a rotational load variation to that roller, wherein, when there are a plurality of processing means imparting a load variation, the roller to which a rotational load variation is being imparted by the processing means imparting the largest load variation is set as a roller that drives the belt; and wherein the transfer brush and the transfer roller have an electrical potential difference and a bias power supply is provided to apply a bias voltage to the transfer brush and the transfer roller to form a bias circuit; and a belt unit, which houses the belt apparatus, and which can be inserted in and removed from the main body portion.

6. The image forming apparatus according to claim 5, further comprising:

a roller drive system including a main body portion side drive system that includes the drive source installed in the main body portion and a belt unit side drive system installed in the belt unit side, wherein the main body portion side drive system and the unit side drive system have structure whereby they can be linked together or separated by a member of a power transmission means that uses frictional contact.

7. The image forming apparatus according to claim 6, wherein a cage body having an aperture in which the belt unit can be installed is provided in the main body portion, and wherein the power transmission means is provided between the belt unit side drive system and the main body side drive system at the far side of the cage body from the aperture in the direction of the insertion of the belt unit into the aperture.

8. The image forming apparatus according to claim 6, wherein the power transmission means includes a combination of a gear of the main body portion side drive system and a gear of the belt unit side drive that is capable of meshing with the gear of the main body portion side drive system.

9. An image forming apparatus comprising:

a belt serving as an intermediate transfer body that has a function of carrying a toner image is extended between two rollers provided facing each other at a distance and the belt is rotated by the two rollers; and processing means used for image formation, the processing means including a) image forming means that is provided with developing means for developing an electrostatic latent image formed in advance on an image carrier as a toner image having a plurality of colors and that causes the image carrier to come into contact with the belt;

b) intermediate transfer means for transferring a toner image on the image carrier that has been developed by the developing means onto the belt, the intermediate transfer means comprising a transfer brush and a transfer roller, wherein the transfer brush and the transfer roller have an electrical potential difference and a bias power supply is provided to apply a bias voltage to the transfer brush and the transfer roller to form a bias circuit; and c) final transfer means for transferring a toner image on the image carrier that has been transferred onto the belt by the intermediate transfer means onto a sheet shaped medium, and wherein processing is performed so that the processing means are made to function while the belt is being rotated, and at least one of the processing means acts on any one of the two rollers via the belt, and wherein, when there are a plurality of processing means imparting a load variation, the roller to which a rotational load variation is being imparted by the processing means imparting the largest load variation is set as a roller that drives the belt, and when the roller to which the largest load variation is imparted by the processing means is set as a roller that drives the belt, the image forming means are placed at the extended surface of the belt which is the non-tensioned side when the drive roller is being driven.

10. The image forming apparatus according to claim 9, wherein the image forming means includes a first image forming means and a second image forming means placed a predetermined distance apart along the surface that is the non-tensioned side extended belt surface when the belt is being driven and that forms the same moving surface of the belt;

the first image forming means is provided with a first image carrier and the second image forming means is provided with a second image carrier, and wherein the first image forming means is provided with the first image carrier and developing means for developing an electrostatic latent image on the first image carrier in A color toner and with developing means for developing an electrostatic latent image on the first image carrier in C color toner, and the second image forming means is provided with the second image carrier and developing means for developing an electrostatic latent image on the second image carrier in B color toner, and there are also provided first intermediate transfer means for transferring onto the belt a toner image formed by the first image forming means at a position opposite the first image forming means with the belt interposed therebetween and second intermediate transfer means for transferring onto the belt a toner image formed by the second image forming means at a position opposite the second image forming means with the belt interposed therebetween.

11. The image forming apparatus according to claim 10, wherein the second image forming means is provided with one second image carrier and with developing means for developing in B color toner and developing means for developing in D color toner an electrostatic latent image on the second image carrier.

12. The image forming apparatus according to claim 9, wherein the belt is extended so that, of the extended surfaces of the belt, at least the non-tensioned side and the tensioned side forming the two extended surfaces are substantially parallel when driven by the drive roller.

13. The image forming apparatus according to claim 9, wherein, when the belt is extended, the non-tensioned side extended surface is positioned facing downwards and the image forming means are placed below the belt facing the non-tensioned side extended surface.

14. The image forming apparatus according to claim 9, further comprising a plurality of image forming means placed a predetermined distance apart along the non-tensioned side extended surface of the belt, wherein developing and transferring are begun from the image forming means positioned closest to the drive roller and toner images are formed in sequence on the belt.

15. The image forming apparatus according to claim 14, wherein the image forming means positioned closest to the drive roller is set as the first image forming means and the second image forming means is positioned at a distance from the first image forming means, and wherein, as the belt rotates, after a A color toner image has been transferred onto the belt by the first image forming means and the first intermediate transfer means, a B color image is transferred on top of the A color toner image by the second image forming means and the second intermediate transfer means, and then a C color toner image is transferred on top of the superposed A and B toner images by the first image forming means and the first intermediate transfer means, and a color toner image formed in the three primary colors A, B, and C is transferred onto a sheet shaped medium by the final transfer means.

16. The image forming apparatus according to claim 15, wherein the final transfer means is placed facing a roller on an opposite side to the drive roller, and the image forming apparatus further comprises:

a transfer path for the sheet shaped medium which has a storage section for storing the sheet shaped medium below the image forming means and which extends in a substantially vertical direction from the storage section to the final transfer means; and a fixing section which is provided in the vicinity of the final transfer means as an extension of the transport path and which fixes superposed toner on the sheet shaped medium that has been transported via the final transfer means.

17. The image forming apparatus according to claim 14, wherein the image forming means positioned closest to the drive roller is set as the first image forming means and the second image forming means is positioned at a distance from the first image forming means, and wherein, as the belt rotates, after a A color toner image has been transferred onto the belt by the first image forming means and the first intermediate transfer means, a B color image is transferred on top of the A color toner image by the second image forming means and the second intermediate transfer means, and then a C color toner image is transferred on top of the superposed A and B toner images by the first image forming means and the first intermediate transfer means, and then a further D color superposed toner image is transferred on top of the A, B, and C color toner images by the second image forming means and the second intermediate transfer means, and a color toner image formed in the four colors A, B, C, and D is transferred onto a sheet shaped medium by the final transfer means.

18. The image forming apparatus according to claim 17, wherein the final transfer means is placed facing a roller on an opposite side to the drive roller, and the image forming apparatus further comprises:

a transfer path for the sheet shaped medium which has a storage section for storing the sheet shaped medium below the image forming means and which extends in a substantially vertical direction from the storage section to the final transfer means; and a fixing section which is provided in the vicinity of the final transfer means as an extension of the transport path and which fixes superposed toner on the sheet shaped medium that has been transported via the final transfer means.

19. The image forming apparatus according to claim 9 further comprising transfer movement means for moving the intermediate transfer means at the non-tensioned side of the belt.

20. The image forming apparatus according to claim 19, wherein the intermediate transfer means includes two or more members provided at a distance from each other.

21. The image forming apparatus according to claim 19, wherein the transfer movement means includes cushioning means for suppressing the intermediate transfer means from abruptly colliding with the belt.

22. The image forming apparatus according to claim 19, wherein the final transfer means is placed facing a roller on an opposite side to the drive roller, and the image forming apparatus further comprises:

a transfer path for the sheet shaped medium which has a storage section for storing the sheet shaped medium below the image forming means and which extends in a substantially vertical direction from the storage section to the final transfer means; and a fixing section which is provided in the vicinity of the final transfer means as an extension of the transport path and which fixes superposed toner on the sheet shaped medium that has been transported via the final transfer means.

23. An image forming apparatus comprising:

a belt having a function of carrying a sheet shaped medium is extended between at least two rollers provided opposite to and at a distance from each other and the belt is rotated by the rollers;

processing means used for image formation, the processing means including, a) image forming means that is provided with developing means for developing an electrostatic latent image formed in advance on an image carrier as a toner image; and b) transfer means for transferring a toner image on the image carrier that has been developed by the developing means onto the sheet shaped medium that has been transported together with the belt, the transfer means comprising a transfer brush and a transfer roller, wherein the transfer brush and the transfer roller have an electrical potential difference and a bias power supply is provided to apply a bias voltage to the transfer brush and the transfer roller to form a bias circuit, and wherein processing is performed so that the processing means are made to function in order to form an image while the belt is being rotated, and at least one of the processing means acts on any one of the two rollers, and wherein, when there are a plurality of processing means imparting a load variation, the roller to which a rotational load variation is being imparted by the processing means imparting the largest load variation is set as a roller that drives the belt, and wherein the drive roller is upstream of the transfer means.

24. An image forming apparatus in which a toner image formed on an image carrier is transferred by intermediate transfer means onto a belt serving as an intermediate transfer body, and the toner image on the belt is transferred onto a sheet shaped medium by final transfer means, wherein the intermediate transfer means comprising a transfer and a transfer roller, wherein the transfer brush and the transfer roller have an electrical potential difference and a bias power supply is provided to apply a bias voltage to the transfer brush and the transfer roller to form a bias circuit, the belt is extended by being suspended between a plurality of rollers that include a drive roller and there is provided image forming means equipped with a single image carrier and developing means for developing an electrostatic latent image on the image carrier in toners of a plurality of colors, the image forming means is provided facing the extended surface of the belt on the non-tensioned side when the belt is being driven, and sensing means is provided at a position facing the extended surface of the belt on the tensioned side when the belt is being driven for detecting a state of the image forming apparatus and allowing control to be performed, and when there are a plurality of processing means imparting a load variation, the roller to which a rotational load variation is being imparted by the processing means imparting the largest load variation is set as the driver roller.

25. The image forming apparatus according to claim 24, wherein the sensing means is mounted facing downwards at the underside of a circuit board for driving and controlling the image forming apparatus main body, and the circuit board is mounted on a structural member of the apparatus body above the belt, and the sensing means faces the extended surface on the tensioned side of the belt via the structural member.

26. An image forming apparatus in which a color toner image formed in at least the three primary colors A, B, and C on an image carrier is transferred by intermediate transfer means onto a belt serving as an intermediate transfer medium, and a color toner image on the belt is transferred onto a sheet shaped medium by final transfer means, wherein the intermediate transfer means comprises a transfer brush and a transfer roller, wherein the transfer brush and the transfer roller have an electrical potential difference and a bias power supply is provided to apply a bias voltage to the transfer brush and the transfer roller to form a bias circuit, the belt is extended by being suspended between a plurality of rollers that include a drive roller, and there is provided a first image forming means and a second image forming means placed at a predetermined distance apart along the surface that forms the same moving surface of the belt, and the first image forming means is provided with a single image carrier and developing means for developing an electrostatic latent image on the image carrier in A color toner and with developing means for developing an electrostatic latent image on the image carrier in C color toner, and the second image forming means is provided with a single image carrier and developing means for developing an electrostatic latent image on the image carrier in B color toner, and when the belt is driven, the first image forming means and the second image forming means are positioned at the non-tensioned extended surface of the belt, and wherein, when there are a plurality of processing means imparting a load variation, the roller to which a rotational load variation is being imparted by the processing means imparting the largest load variation is set as the driver roller.

27. The image forming apparatus according to claim 26, wherein the sensing means is mounted facing downwards at the underside of a circuit board for driving and controlling the image forming apparatus main body, and the circuit board is mounted on a structural member of the apparatus body above the belt, and the sensing means faces the extended surface on the tensioned side of the belt via the structural member.

28. The image forming apparatus according to claim 26, wherein, out of the plurality of image forming means provided a fixed distance apart along an extended surface of the belt which is the non-tensioned side of the belt, developing and transferring are begun from the image forming means positioned closest to the drive roller and toner images are formed in sequence on the belt, and the sensing means is placed at a position at the extended surface on the tensioned side of the belt slightly away from the drive roller, and an image is formed by sequentially superposing toner images on the belt.

29. An image forming apparatus in which a toner image formed in at least three primary colors A, B, and C on an image carrier is transferred onto a belt extended by being suspended between a plurality of rollers including a drive roller, the image forming apparatus comprising:

a belt, which is suspended between a plurality of rollers such that a non-tensioned side extended belt surface, which is an image holding surface onto which an image is transferred from among the belt surfaces, faces downwards and a tensioned side extended belt surface faces upwards, and whose drive roller and rotation direction are determined;

sensing means for detecting a state of the image forming apparatus and allowing control to be performed;

a first image carrier and a second image carrier on which an electrostatic latent image is formed are positioned in sequence in a direction of movement of the belt below the non-tensioned side extended belt surface;

a first developing means for developing an electrostatic latent image on the first image carrier from among the image carriers in A color and C color toner and a second developing means for developing an electrostatic latent image on the first image carrier from among the image carriers in at least B color toner, the first developing means and second developing means being positioned in the same way in sequence in a direction of movement of the belt below the non-tensioned side extended belt surface which is the belt holding surface;

a first transfer means positioned facing the first image carrier and the second image carrier for transferring a toner image formed on the first image carrier and the second image carrier onto the belt, the first transfer means comprises a transfer potential difference and a bias power supply is provided to apply a bias voltage to the transfer brush and the transfer roller to form a bias circuit;

a second transfer means positioned in the vicinity of the downstream side of the second image carrier in the direction of movement of the belt for transferring a toner image formed in color on the belt onto a sheet shaped medium;

a transport path on which the sheet shaped medium is supplied by paper supply means and is fed from the bottom of the apparatus body towards the top of the apparatus body facing the second transfer means; and a fixing apparatus positioned above the belt in the vicinity of the second transfer means for fixing a toner image transferred by the second transfer means on the sheet shaped medium, wherein, when there are a plurality of processing means imparting a load variation, the roller to which a rotational load variation is being imparted by the processing means imparting the largest load variation is set as the drive roller.

30. A belt apparatus used in forming images, the belt apparatus comprising:

at least two roller units provided opposite to and at a distance from each other, one of the roller units being a drive roller unit driven by a driving system;

a belt mounted on the roller units and which rotates when the drive roller unit is driven;

a plurality of processing units arranged around the belt and which form an image on the belt while the belt is moving, one of the processing units is an intermediate transfer means comprising a transfer brush and a transfer roller, wherein at least one processing unit acts on any one of the roller units while an image is being formed on the belt thereby imparting a variation in the rotational load to that roller unit, and wherein the transfer brush and the transfer roller have an electrical potential difference and a bias power supply is provided to apply a bias voltage to the transfer brush and the transfer roller to form a bias circuit, wherein driving system drives the roller unit whose rotational load is varied by the processing unit, wherein the driving system that drives the drive roller unit includes a drive source, and a driving mechanism including frictional contact portions that link the drive source and the drive roller unit, and wherein, when there are a plurality of processing units imparting a load variation, the roller unit to which a rotational load variation is being imparted by the processing units imparting the largest load variation is set as the drive roller unit.

31. The belt apparatus according to claim 30, wherein each one of the roller unit includes a single roller.

32. The belt apparatus according to claim 30, wherein each one of the roller unit includes a plurality of rollers having the same axis of rotation.

33. The belt apparatus used for image formation according to claim 30, wherein the processing units include at least one cleaning unit provided near one or both of the roller units, each cleaning unit includes, a cleaning blade that scraps and accumulates the unwanted developing agent on the belt while the belt is being rotated.

34. The belt apparatus used for image formation according to claim 33, wherein the cleaning unit further includes, a cleaning blade moving system that moves the cleaning blade towards or away from the belt; and a cushioning unit which suppresses the impact when the cleaning blade comes into contact with the belt.

35. The belt apparatus used for image formation according to claim 33, wherein the cleaning unit further includes, a waste processing unit including a waste container; and a sweeping unit which accumulates the developing agent scraped by the cleaning blade in the waste container; and a waste processing unit drive system which drives the waste processing unit using the driving force of the driving system that drives the drive roller unit.

36. An image forming apparatus comprising:

a main body portion that houses different parts;

a belt apparatus including, at least two roller units provided opposite to and at a distance from each other, one of the roller units being a drive roller unit driven by a driving system;

a belt mounted on the roller units and which rotates when the drive roller unit is driven;

a plurality of processing units arranged around the belt and which form an image on the belt while the belt is moving, one of the processing units is an intermediate transfer means comprising a transfer brush and a transfer roller, wherein at least one processing unit acts on any one of the roller units while an image is being formed on the belt, and wherein the transfer brush and the transfer roller have an electrical potential difference and a bias power supply is provided to apply a bias voltage to the transfer brush and the transfer roller to form a bias circuit, wherein, when there are a plurality of processing units imparting a load variation, the roller unit to which a rotational load variation is being imparted by the processing units imparting the largest load variation is set as to drive roller unit; and a belt unit, which houses the belt apparatus, and which can be inserted in and removed from the main body portion.

37. The image fanning apparatus according to claim 36, wherein the driving system that drives the drive roller unit includes, a drive source installed in the main body portion outside the belt unit; and a driving mechanism including interlocking convex and concave portions or frictional contact that link the drive source and the drive roller unit, wherein the link between the drive source and the drive roller unit is disengageable.

38. The belt apparatus used for image formation according to claim 36, wherein the processing units include at least one cleaning unit provided near one or both of the roller units, each cleaning unit includes, a cleaning blade that scraps and accumulates the unwanted developing agent on the belt while the belt is being rotated.

39. The belt apparatus used for image formation according to claim 38, wherein the cleaning unit further includes, a cleaning blade moving system that moves the cleaning blade towards or away from to belt; and a cushioning unit which suppresses the impact when the cleaning blade comes into contact with the belt.

40. The belt apparatus used for image formation according to claim 38, wherein the cleaning unit further includes, a waste processing unit including a waste container; and a sweeping unit which accumulates the developing agent scraped by the cleaning blade in the waste container; and a waste processing unit drive system which drives the waste processing unit using the driving force of the driving source.

41. The belt apparatus used for image formation according to claim 40, wherein the waste processing unit drive system includes, a driving mechanism including interlocking convex and concave portions or frictional contact that link with the drive source, wherein the link between the waste processing unit drive system and the drive source is disengageable.

42. An image forming apparatus comprising:

at least two roller units provided opposite to and at a distance from each other, one of the roller units being a drive roller unit driven by a driving system;

a belt mounted on the roller units and which rotates when the drive roller unit is driven, which belt serves as an intermediate transfer body that carries a toner image;

a plurality of processing units arranged around the belt and which form an image on the belt while the belt is moving, the processing unit includes, a) an image forming unit including developing unit which develops an electrostatic latent image formed in advance on an image carrier as a toner image having a plurality of colors, and an image carrier moving unit that moves the image carrier such that the image carrier come into contact with the belt;

b) an intermediate transfer unit which transfers the toner image from the image carrier to the belt, the intermediate transfer unit comprising a transfer brush and a transfer roller, wherein the transfer brush and the transfer roller have an electrical potential difference and a bias power supply is provided to apply a bias voltage to the transfer brush and the transfer roller to form a bias circuit; and c) a final transfer unit which transfers the toner image from the belt to a medium, and wherein at least one processing unit acts on any one of the roller units while an image is being formed on the belt thereby imparting a variation in the rotational load to that roller unit, and wherein, when there are a plurality of processing units imparting a load variation, the roller unit to which a rotational load variation is being imparted by the processing units imparting the largest load variation is set as the drive roller unit, and the image forming unit of each processing unit is placed at the extended surface of the belt which is the non-tensioned side when the drive roller is being driven.

43. The belt apparatus according to claim 42, wherein each one of the roller unit includes a single roller.

44. The belt apparatus according to claim 42, wherein each one of the roller unit includes a plurality of rollers having the same axis of rotation.

45. The image forming apparatus according to claim 42, wherein the image forming unit includes, a first image forming unit which includes, a first image carder;

a A color developing unit for developing an electrostatic latent image on the first image carrier in A color toner; and a C color developing unit for developing an electrostatic latent image on the first image carrier in C color toner;

a second image forming unit which includes, a second image carrier;

a B color developing unit for developing an electrostatic latent image on the second image carrier in B color toner, and wherein the first and second image forming units are placed a predetermined distance apart along the surface that is the non-tensioned side extended belt surface when the belt is being driven and that forms the seine moving surface of the belt; and a first intermediate transfer unit, provided at a position opposite to the position of the first image forming unit with the belt interposed therebetween, which transfers a toner image from the first image carrier of the first image forming unit to the belt; and a second intermediate transfer unit, provided at a position opposite to the position of the second image forming unit with the belt interposed therebetween, which transfers a toner image from the second image carrier of the second image forming unit to the belt.

46. The image forming apparatus according to claim 45, wherein the second image forming unit further includes a D color developing unit for developing an electrostatic latent image on the second image carrier in D color toner.

47. The image forming apparatus according to claim 46, further comprising:

a sensing unit, provided at a position facing the extended surface of the belt on the tensioned side when the belt is being driven, which detects a state of the image forming apparatus; and a control unit which provides control based on the state of the image forming apparatus detected by the sensing unit.

48. The image forming apparatus according to claim 47, wherein the sensing unit is mounted facing downwards at the underside of the control unit, and the control unit is mounted on a structural member of the apparatus body above the belt, and the sensing unit faces the extended surface on the tensioned side of the belt via the structural member.

49. The image forming apparatus according to claim 47, wherein, out of the plurality of image forming unit provided a fixed distance apart along an extended surface of the belt which is the non-tensioned side of the belt, developing end transferring are begun from the image forming unit positioned closest to the drive roller and toner images are formed in sequence on the belt, and the sensing unit is placed at a position at the extended surface on the tensioned side of the belt slightly away from the drive roller, and an image is formed by sequentially superposing toner images on the belt.

50. The image forming apparatus according to claim 45, wherein the first image forming unit is positioned closest to the drive roller and, and the second image forming unit is positioned after the first image forming unit with respect to the drive roller, and as the belt rotates, the first image fanning unit develops the A color toner image on the first image carrier, and the first intermediate transfer unit transfers the A color toner image from the first image carrier to the belt.

then, the second image forming unit develops the B color toner image on the second image carrier, and the second intermediate transfer unit transfers the B color toner image from the second image carrier to the belt, then, the first image forming unit develops the C color toner image on the first image carrier, and the first intermediate transfer unit transfers the C color toner image from the first image carrier to the belt, and the final transfer unit transfers the color toner images formed in the colors A, B, arid C from the belt to the medium.

51. The image forming apparatus according to claim 50, wherein the final transfer unit is placed facing a roller on an opposite side to the drive roller, and the image forming apparatus further comprises:

a transfer path for the sheet shaped medium which has a storage section for storing the sheet shaped medium below the image forming unit and which extends in a substantially vertical direction from the storage section to the final transfer unit; and a fixing section which is provided in the vicinity of the final transfer unit as an extension of the transport path and which fixes superposed toner on the sheet shaped medium that has been transported via the final transfer unit.

52. The image forming apparatus according to claim 46, wherein the first image forming unit is positioned closest to the drive roller and, and the second image forming unit is positioned after the first image forming unit with respect to the drive roller, and as the bolt rotates, the first image forming unit develops the A color toner image on the first image carrier, and the first intermediate transfer unit transfers the A color toner image from the first image carrier to the belt, then, the second image forming unit develops the B color toner image on the second image carrier, and the second intermediate transfer unit transfers the B color toner image from the second image carrier to the belt, then, the first image forming unit develops the C color toner image on the first image carrier, and the first intermediate transfer unit transfers the C color toner image from the first image carrier to the bolt, then, the second image forming unit develops the D color toner image on the second image carrier, and the second intermediate transfer unit transfers the D color toner image from the second image carrier to the belt, and the final transfer unit transfers the color toner images formed in the colors A, B, C and D from the belt to the medium.

53. The image forming apparatus according to claim 52, wherein the final transfer unit is placed facing a roller on an opposite side to the drive roller, and the image forming apparatus further comprises:

a transfer path for the sheet shaped medium which has a storage section for storing the sheet shaped medium below the image forming unit and which extends in a substantially vertical direction from the storage section to the final transfer unit; and a fixing section which is provided in the vicinity of the final transfer unit as an extension of the transport path and which fixes superposed toner on the sheet shaped medium that has been transported via the final transfer unit.

54. The image forming apparatus according to claim 45 further comprising:

a sensing unit, provided at a position facing the extended surface of the belt on the tensioned side when the belt is being driven, which detects a state of the image forming apparatus; and a control unit which provides control based on the state of the image forming apparatus detected by the sensing unit.

55. The image forming apparatus according to claim 54, wherein the sensing unit is mounted facing downwards at the underside of the control unit, and the control unit is mounted on a structural member of the apparatus body above the belt, and the sensing unit faces the extended surface on the tensioned side of the belt via the structural member.

56. The image forming apparatus according to claim 54, wherein, out of the plurality of image forming unit provided a fixed distance apart along an extended surface of the belt which is the non-tensioned side of the belt, developing and transferring are begun from the image forming unit positioned closest to the drive roller and toner images are formed in sequence of the belt, and the sensing unit is placed at a position at the extended surface on the tensioned side of the belt slightly away from the drive roller, and an image is formed by sequentially superposing toner images on the belt.

57. The image forming apparatus according to claim 42, wherein the belt is extended so that, of the extended surfaces of the belt, at least the non-tensioned side and the tensioned side forming the two extended surfaces are substantially parallel when driven by the drive roller.

58. The image forming apparatus according to claim 42, wherein, when the belt is extended, the non-tensioned side extended surface is positioned facing downwards and the image forming unit of all the processing units are placed below the bolt facing the non-tensioned extended surface.

59. The image forming apparatus according to claim 42, wherein the image forming unit of all the processing units are placed at a predetermined distance apart along the non-tensioned side extended surface of the belt, and the image forming unit positioned closest to the drive roller starts the formation of the toner image first, the other image forming units start the formation of the toner image in accordance with their position form the drive roller.

60. The image forming apparatus according to claim 42, wherein the processing unit further includes a transfer movement unit which moves the intermediate transfer unit at the non-tensioned side of the belt.

61. The image forming apparatus according to claim 60, wherein the intermediate transfer unit includes two or more members provided at a distance from each other.

62. The image forming apparatus according to claim 60, wherein the transfer movement unit includes a cushioning unit for suppressing the intermediate transfer unit from abruptly colliding with the belt.

63. An image forming apparatus comprising:

at least two roller units provided opposite to and at a distance from each other, one of the roller units being a drive roller unit driven by a driving system;

a belt mounted on the roller units and which rotates when the drive roller unit is driven and carries a sheet shaped medium;

a plurality of processing units arranged around the belt and which form an image on the belt while the belt is moving, the processing unit includes, a) an image forming unit including a developing unit which develops an electrostatic latent image formed in advance on an image carrier as a toner image; and b) a transfer unit which transfers the toner image from the image carrier to the medium transported by the belt, the transfer unit comprising a transfer brush and a transfer roller, wherein the transfer brush and the transfer roller have an electrical potential difference and a bias power supply is provided to apply a bias voltage to the transfer brush and the transfer roller to form a bias circuit, and wherein at least one processing unit acts on anyone of the roller units while an image is being formed on the belt thereby imparting a variation in the rotational load to that roller unit, wherein, when there are a plurality of processing units imparting a load variation, the roller unit to which a rotational load variation is being imparted by the processing units imparting the largest load variation is set as the drive roller unit, and wherein the drive roller unit is upstream of the transfer unit.

* * * * *